US009289903B1

(12) United States Patent
Douzanis

(10) Patent No.: US 9,289,903 B1
(45) Date of Patent: Mar. 22, 2016

(54) KNIFE DRAW ASSEMBLY

(76) Inventor: Ronald E. Douzanis, Lakeville, MA (US)

( * ) Notice: Subject to any disclaimer, the term of this patent is extended or adjusted under 35 U.S.C. 154(b) by 498 days.

(21) Appl. No.: 13/362,050

(22) Filed: Jan. 31, 2012

(51) Int. Cl.

| | |
|---|---|
| ***B26D 1/08*** | (2006.01) |
| ***B26B 29/02*** | (2006.01) |
| ***B26B 1/02*** | (2006.01) |
| ***A45F 5/02*** | (2006.01) |

(52) U.S. Cl.
CPC .. *B26B 1/02* (2013.01); *A45F 5/021* (2013.01)

(58) Field of Classification Search
USPC ..... 30/151–164, 298.4, 296.1; 224/269
See application file for complete search history.

(56) References Cited

U.S. PATENT DOCUMENTS

| | | | | |
|---|---|---|---|---|
| 1,725,064 | A * | 8/1929 | Easton | 30/123 |
| 1,836,014 | A * | 12/1931 | Chamberlain | 30/327 |
| 3,216,288 | A * | 11/1965 | Gardner | 408/202 |
| 3,657,812 | A * | 4/1972 | Lee | 30/162 |
| 4,337,576 | A * | 7/1982 | Drost et al. | 30/162 |
| 4,805,819 | A * | 2/1989 | Collins | 224/232 |
| 5,572,793 | A * | 11/1996 | Collins et al. | 30/157 |
| 6,397,477 | B1 * | 6/2002 | Collins | 30/161 |
| 7,344,054 | B2 * | 3/2008 | Sakai et al. | 224/269 |
| 8,028,873 | B2 * | 10/2011 | Hawk et al. | 224/269 |
| 8,112,894 | B2 * | 2/2012 | Caswell | 30/151 |
| 8,636,170 | B2 * | 1/2014 | LaFever | 220/710 |
| 8,745,878 | B2 * | 6/2014 | Glesser | 30/155 |
| 8,752,298 | B2 * | 6/2014 | Collins et al. | 30/160 |

* cited by examiner

*Primary Examiner* — Omar Flores Sanchez
(74) *Attorney, Agent, or Firm* — Milstein Zhang & Wu LLC; Joseph B. Milstein

(57) ABSTRACT

A removable knife draw assembly for a folding knife. The removable knife draw assembly may be structured as a clip assembly and include a modified clip and other components which can be used in various combinations, including one or more of a clip draw tab, a body draw tab, a height adjuster, a tensioner, a tensioner pad, and a platform. The removable knife draw assembly provides structures that allow a user to engage and use the knife in an efficient manner. In this configuration, the removable clip assembly provides a removable clip to adjustably position the folding knife to a pocket, holster or other container, the removable clip having one or more of a clip draw tab to remove the knife from the container, a height adjuster to position the folding knife in the container and a tensioning mechanism to secure the folding knife in the container with the proper resistance.

18 Claims, 28 Drawing Sheets

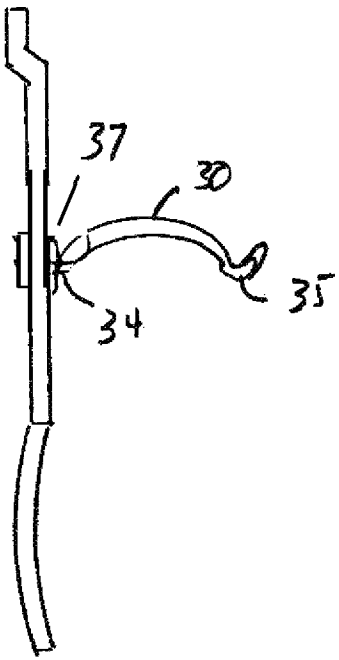
FIG. 9B
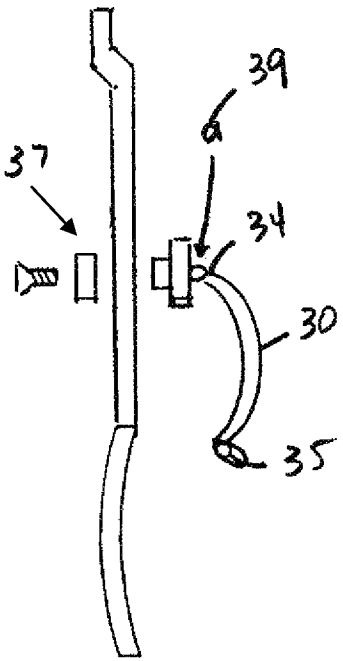
FIG. 9A
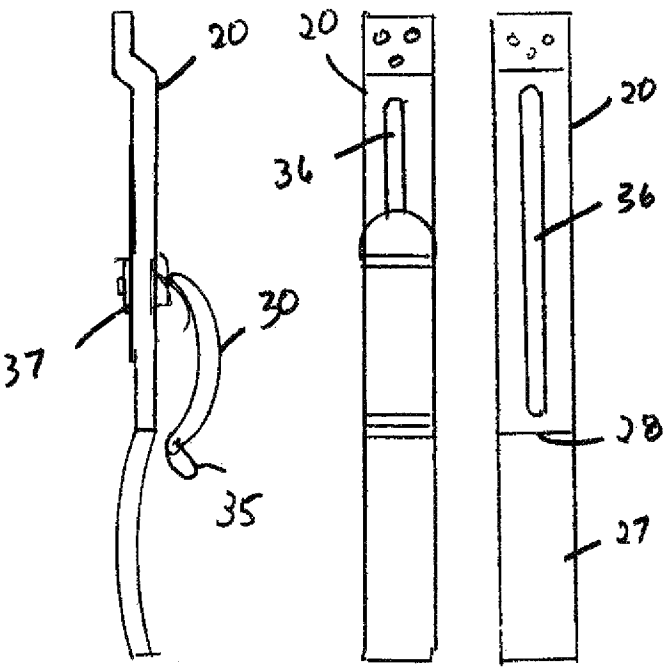
FIG. 7B FIG. 8
FIG. 7A

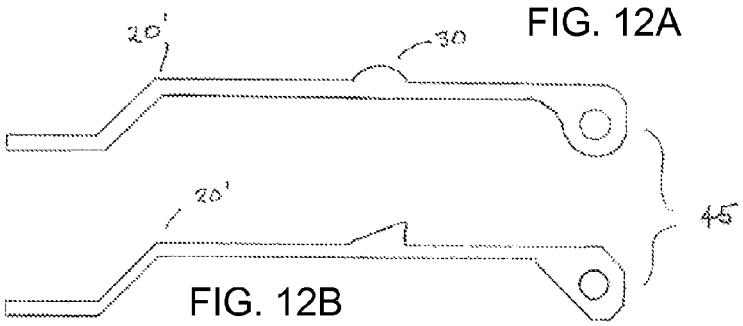
FIG. 12A
FIG. 12B
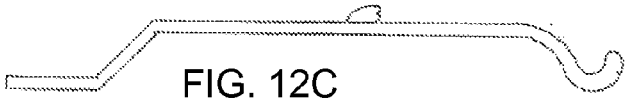
FIG. 12C
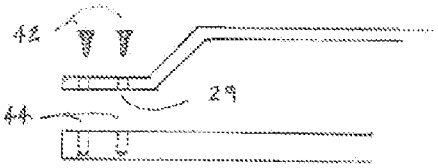
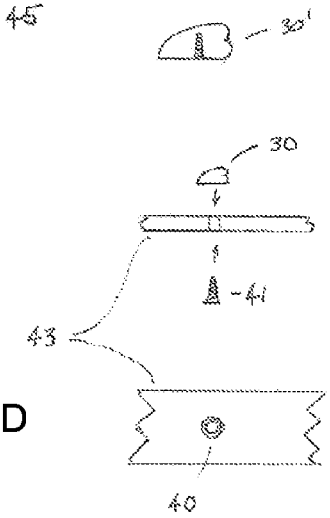
FIG. 12D
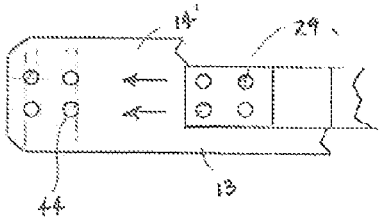
FIG. 12E 29
20'
76
66
67
68
69
71
72
70
74
75
73
78
77
14'

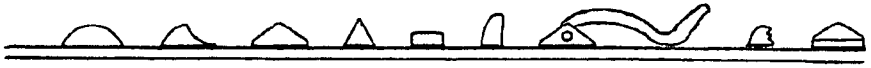
FIG. 18A
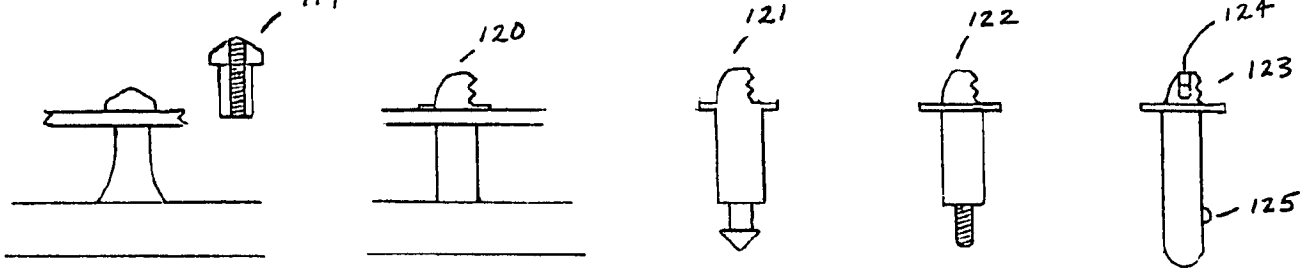
FIG. 18B
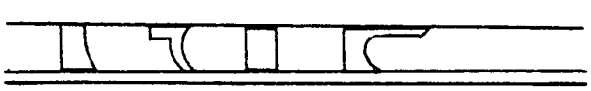
FIG. 18D
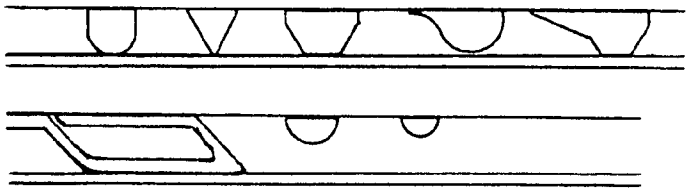
FIG. 18E
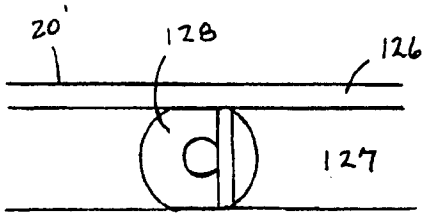
FIG. 18C
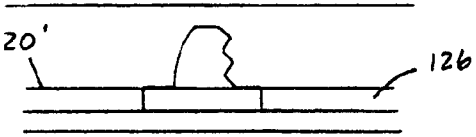

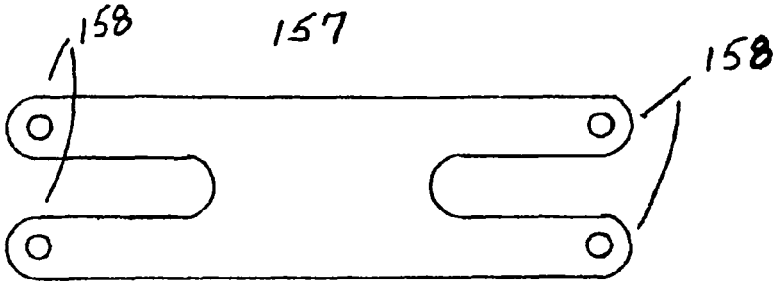
FIG. 22A
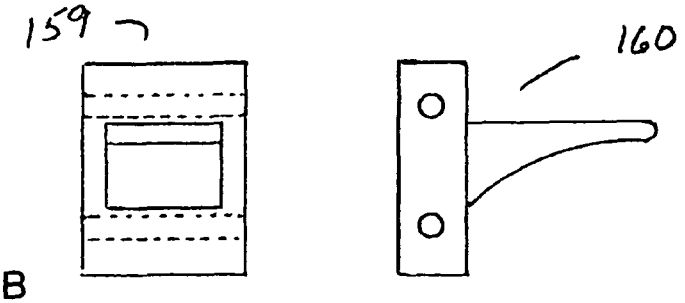
FIG. 22B
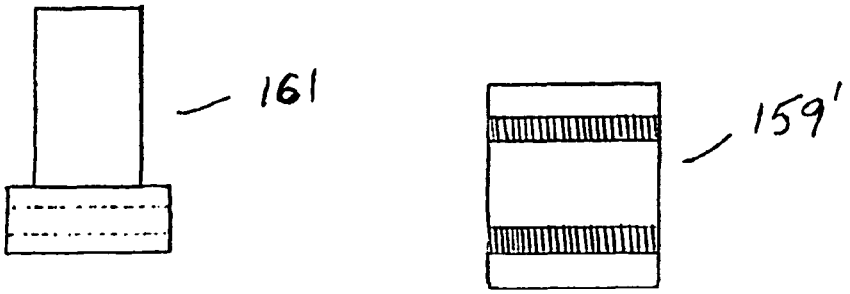

FIG. 22C
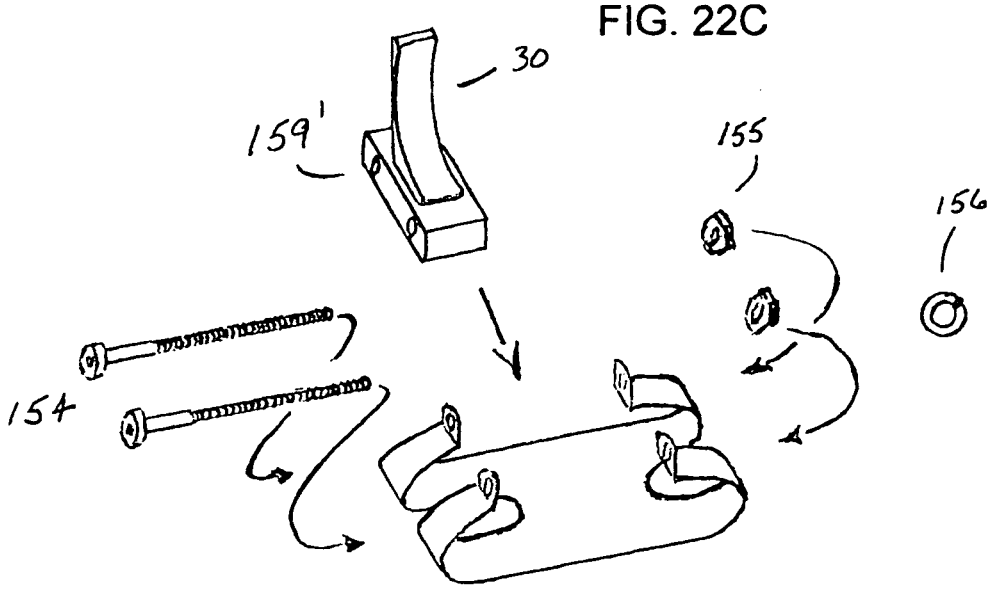
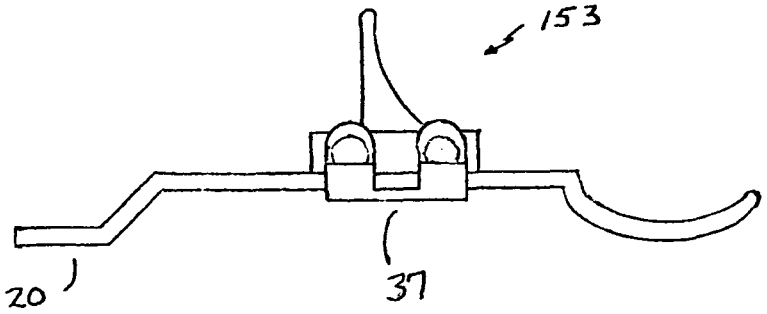
FIG. 22D

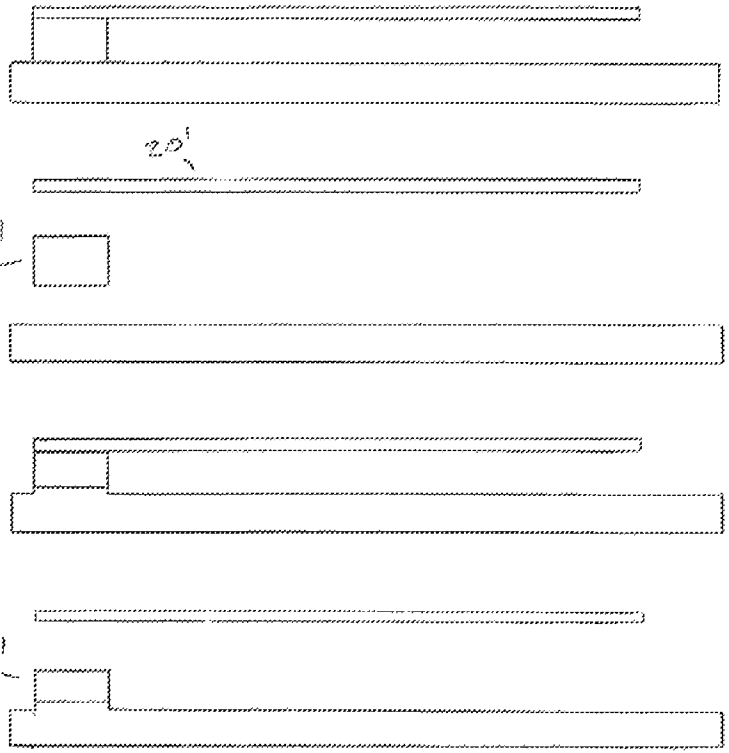
FIG. 29A
FIG. 29B
FIG. 29C
FIG. 29D
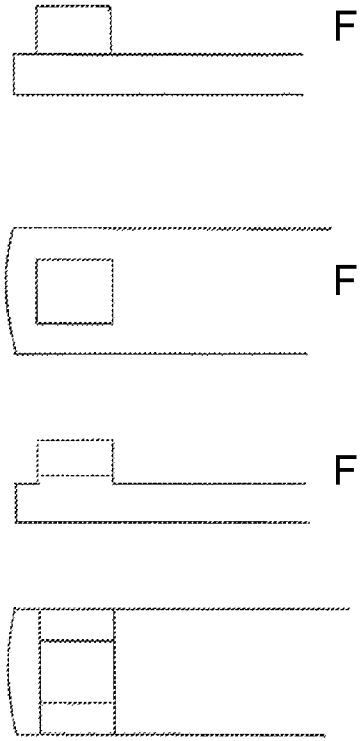
FIG. 29E
FIG. 29F
FIG. 29G
FIG. 29H

KNIFE DRAW ASSEMBLY

FIELD OF THE INVENTION

This invention relates to folding knives, which includes folding pocket knives.

BACKGROUND OF THE INVENTION

Handheld folding knives have been used for many years for many purposes, including for self-defense. Using a folding knife as a weapon first requires withdrawing the knife from a contained location, such as from a pocket, a sheath, a holster, or a container. The second aspect of using a folding knife as a weapon is to unfold the knife. Using a folding knife can be difficult in a stressful situation, such as self-defense. Stress increases the difficulty of performing ordinary motor skills. Advanced motor skills often require extensive and dedicated training. When an individual is confronted with a situation that demands stress management and the execution of advanced motor skills, a successful outcome may be very challenging.

The basic concept behind a folding knife is that it can be stored safely in a pocket or container. A folding knife occupies a small amount of space in one's pocket and is also safe to handle when in the folded position as the cutting edge of the blade is safely and securely stored within the handle and facing away from an open surface.

Thus, there is a need for providing apparatus and procedures for modifying a conventional folding knife so that the knife may be more efficiently utilized.

SUMMARY OF THE INVENTION

In one aspect, the present invention relates to a variety of components which may be used individually or in various combinations. In combination these components may form an assembly or a sub-assembly. These components may be used with an existing clip or they may be used with a modified or custom clip, as a clip assembly or they may be used without a clip. They may be formed as part of the knife or they may be removable structures which are attached to the knife, to a clip or to both the knife and clip. The components are comprised of a modified clip, a clip draw tab, a body draw tab, a height adjuster, a tensioner, a tensioner pad, and a platform. In one aspect, the present invention relates to a knife draw assembly for a folding knife, comprising a modified clip and other components which can be used in various combinations, including one or more of a clip draw tab, a body draw tab, a height adjuster, a tensioner, a tensioner pad, a platform. The knife draw assembly for a folding knife provides structures in various embodiments that allow a user to engage and use the knife in an efficient manner. In general, the knife draw assembly provides a removable clip to adjustably position the folding knife to a pocket, holster or other container, the removable clip having one or more of a clip draw tab to remove the knife from the container, a height adjuster to position the folding knife in the container and a tensioning mechanism to secure the folding knife in the container with the proper resistance. In various embodiments, the knife draw assembly for a folding knife can be provided as a component of a folding knife or as a removable assembly that can be attached to a pre-existing folding knife. One specific way to utilize a folding knife in a more efficient manner is to provide means to perform a better knife draw. The aforementioned components will provide means for the user to achieve an efficient knife draw. The tabs are engaged by the user to facilitate optimal vertical draw force for an efficient removal of the knife from a holster, pocket or other container. The height adjuster provides mechanical structure which allows adjustability in the elevation of the knife as it rests in the pocket, holster, sheath or other container. The tensioner and tensioner pad provide a means to adjust for the best amount of resistance for knife retention and draw. A platform is a structure upon which a modified clip may be mounted. The platforms and modified clips afford a variety of functionality options for the folding knife. Mounting hardware is described which when attached to the knife, will reduce maintenance time.

The present invention comprises a clip draw tab which is positioned perpendicular to the long axis of a clip and perpendicular to the flat side plane of the clip. The clip draw tab is engaged by the user to facilitate optimal vertical draw force for an efficient removal of the knife from a holster, pocket or other container. The clip draw tab may be comprised of an attachment portion and a user contact portion. The contact portion is the portion of the tab the user engages with a finger or other part of the hand to generate lift. The contact portion may be rigid and protrude perpendicular to the long axis of the clip or the tab may be comprised of a built-in pivot assembly where the contact portion of the tab remains parallel to the long axis of the clip either freely or spring-bound until engaged by the user at which time the tab is allowed to pivot to a stop-position perpendicular to the long axis of the clip. The contact portion of the tab which is engaged by the user is cast or shaped in an ergonomic geometry. The clip draw tab may be cast or shaped as an integral geometry of the clip or the tab may be a removable component which is attached to a conventional (standard) clip or a custom clip (one which is designed specifically for mating with the tab). The clip draw tab may be adjustably positioned and secured at any location along the clip to provide the best mechanical layout to enable a draw by the user.

The present invention comprises a body draw tab which is positioned perpendicular to the long axis of a knife body and perpendicular to the flat side plane of the knife body. The body draw tab is engaged by the user to facilitate optimal vertical draw force for an efficient removal of the knife from a holster, pocket or other container. The body draw tab may be comprised of an attachment portion and a user contact portion. The contact portion is the portion of the tab the user engages with a finger or other part of the hand to generate lift. The contact portion may be rigid and protrude perpendicular to the long axis of the knife body or the tab may be comprised of a built-in pivot assembly where the contact portion of the tab remains parallel to the long axis of the knife body either freely or spring-bound until engaged by the user at which time the tab is allowed to pivot to a stop-position substantially perpendicular to the long axis of the knife body. The contact portion of the tab which is engaged by the user is cast or shaped in an ergonomic geometry. The body draw tab may be placed or constructed on either or both sides of the knife body; it may also be placed opposite the knife clip. In the configuration which does not include a clip and there are body draw tabs on each side of the knife, the folded knife may reside entirely inside the container or it may be held oriented by the exterior body draw tab. When held oriented by the exterior body draw tab, the knife will slide into the container until the body draw tab makes contact with the upper rim of the container. Due to the protruding shape and material strength of the body draw tab, the knife will be rigidly held in that position. Essentially, in this capacity, the body draw tab has a dual purpose of body draw tab and height adjuster. The body draw tab may be cast or shaped as an integral geometry of the knife body or the tab may be a removable component which is attached to a conventional (standard) knife body or a custom knife body (one which is designed specifically for a mating with the tab). The body draw tab may be adjustably positioned and secured at any location along the knife body to provide the best mechanical layout to enable an efficient draw by the user. The body draw tab is shaped in a fashion that affords optimal interaction with the interior of the pocket, holster or other container. When external pressure is applied to the outside of the pocket, for instance, any sharp protrusion would be directed inward against the user potentially causing discomfort or abrading the pocket material. Therefore the profile of the body draw tab is such as to cooperate with the user and the container. The texture on the surface of the body draw tab may be shaped to provide maximum vertical resistance against the surface of the hand during the draw. Utilizing the body draw tab(s) requires only a minimum amount of pinching force to execute the draw.

The present invention comprises unique clips which can be shaped or formed in a way to receive components such as those described in the removable knife draw assembly for a folding knife. These components can be singly attached or combined. The clip is capable of accommodating all components in multiple arrangements to optimize an efficient use of the folding knife. The clip can be positioned by its mounting hardware in various configurations. For instance eight of these configurations involve the following combinations: for a forward facing and a rearward facing blade and for an upward and downward knife tip orientation and for left and right side. In the folded position, the point of the knife blade rests at one end of the knife. When the clip is mounted at this end of the knife, it will rest in the container with the point of the blade directed to the open end of the container. When the clip is mounted at the opposite end of the knife, the point of the blade will be directed to the closed end of the container. In the folded position, the back of the knife blade is visible or open on one edge of the knife. When the clip is mounted on one side of the knife, the back of the knife blade will be facing forward, for instance, when placed in the right pocket but will be facing rearward when placed in the left pocket. This is reversed when the clip is positioned on the other side. The clip orientation, relative to folding knives, when using the Knife Opening Assist (a device described in U.S. Pat. No. 8,065,804 which utilizes a snagging geometry to mechanically leverage folding knives blades open during the drawing process) is such that the clip's mount is located at the same end as the blade's point when the knife is folded.

The present invention comprises a height adjuster. The height adjuster provides mechanical structure which allows adjustability of knife height as it rests clipped in a pocket, holster or other container. In addition, folding knife designs do not provide a means to adjust the height at which the knife sits in the pocket. This limits the draw-style options for the user. For instance, examine the features of the human hand. The web of the hand which lies between the index finger and thumb is fixed dimensionally. When the thumb is inserted in the pocket while the index finger remains outside the pocket the depth at which an individual can access a knife is thus limited or fixed by the web. Adjustability of the knife resting-height allows the user optimum hand-access to the knife which enables a speedier and more secure draw. The height adjuster is an assembly which is mounted to the clip or to the body of the knife or both. For conventional knife clips, the pocket rests on the upper interior end of the clip where the clip is mounted to the knife body and this position is fixed. The height adjuster provides an adjustable structure which resides in the interior between the clip and the body of the knife. It may also be a stand-alone feature which protrudes outside the body of the knife when in the absence of a clip. When used with a clip and the clip is attached to a container, the knife will slide down until the container meets the height adjuster which supports the knife in place and does not allow it to slide down to the limits of the clip's mounting apparatus. When used without a clip, the height adjuster attaches to the body of the knife and faces outward from the container. In this way, the knife will slide into the container until the height adjuster makes contact with the upper rim of the container. The height adjuster structure may be comprised of a pin, a bolt or other mechanical feature with or without a bushing that can be fastened to the clip and/or knife body. The shape of the clip and knife body are designed or tooled to allow the feature to be positioned and secured at any desired location along the knife. Due to the protruding shape and material strength of the height adjuster, the knife will be rigidly held in that position. The height adjuster and some body draw tabs may be interchanged as they can provide a dual purpose.

The present invention comprises a tensioner. The tensioner provides a means to adjust for the best amount of resistance for knife retention and draw. There should be enough pinching resistance from the clip and body of the knife on the material of the container to prevent the knife from falling out of the container, for example, when the container is inverted and/or is moving. This resistance should not be so much as to interfere with the ability of the user to draw the knife efficiently. The tensioner is a mechanical structure that enables pressure to be applied to the outside of the clip. Pins and bolts are two examples among many which can be used to accomplish this. While securing the pins or bolts variable amounts of tension may be applied to the clip. In one example, the tension may be increased by threading a bolt further into a threaded plate. The bolt exerts compressive force on the elastic clip which drives the clip's contact point or tensioner pad more forcibly against the knife body. The greater the displacement of the clip, the greater the retaining force applied to the contact point or tensioner pad at the end of the clip. This in turn squeezes the material of the container. Since containers are made of a wide range of materials, adjustability of the clip's tension is essential to obtain the desired results of tension for retention and draw as discussed earlier. For instance, the tensioner can be utilized to maximize holding resistance for optimal retention. In addition, the tensioner provides knives with longer operating life before disassembly and maintenance is required by allowing for adjustment of the natural weakening and bending of the clip.

The present invention comprises a tensioner pad. The tensioner pad can be an inherent aspect of a clip or it can be a removably attachable component of the clip. It acts as a mechanical stand-off at the free end of the clip. The tensioner pad positions the clip away from the body of the knife. It allows for adjustment in the size and shape of the channel which lies between the clip and body of the knife. The tensioner pad also is the portion of the clip that exerts pressure on the material of the container. The shape of the tensioner pad determines the footprint with which the pressure is applied. In fact, the material contact surface of the pad may be shaped to provide different characteristics, for instance, course sandpaper features to enhance resistance or polished chrome for reduced resistance. The tensioner pad may be constructed from high-strength magnetic material which will also optimize knife retention when mounted opposite a ferrous-metal plate or the knife blade.

The present invention comprises a platform. The platform is a structure that can be removably attachable to the body of the knife or it may be an inherent component of the knife body. The platform provides a number of functions but its main purpose is to provide an attachment point for another embodiment of a clip, which will be referred to as a modified clip. Additional features afforded by the platform are tensioner, height adjuster, rotating clip hardware and clip draw tab.

The present invention comprises a modified clip. The modified clip differs from a conventional clip. In one embodiment a modified clip is comprised of a single straight piece of high-elastic strength sheet metal. The modified clip is shaped or formed to contain apertures or channels or other features which enable it to cooperate with all the components described. In another format the modified clip is bent over itself to form a clip-plate combination. Additional formats of the modified clip are shown which cooperate with the described components.

The present invention comprises a rotating clip and platform with locking pin for ease of maintenance. Conventional folding knife clips are prone to bending with repeated use, which reduces their retention in the pocket. One method to correct the bent clip is to remove the fastening screws and then the clip, bend the clip back in to a proper shape, and then reattach the clip. This technique is slow and sometimes difficult, especially if the mounting screws are over torqued and the socket threads become stripped-out. For use with near-elastic materials, bending is inevitable. These mechanical structures facilitate maintenance procedures such as straightening of a bent clip or the addition and removal of components.

In a blade-stored condition, one way to contain a folding knife is to insert the knife into a pocket with the clip outside the pocket. The gap between the clip and the knife handle receives the material of the pocket. One method of drawing the knife is to insert the thumb, forward of or along the body of the knife, into the pocket while the index finger or other finger points downward outside the pocket but in front of the clip draw tab. When the web of the hand between the thumb and the index finger makes contact with the fabric of the pocket's upper seam, the index finger or other finger is flexed and engages the clip draw tab while the thumb engages the body draw tab. The knife is then lifted up and out.

In a blade-stored condition, another way to contain a folding knife is to insert the knife into a container with an exterior body draw tab. The knife rests on the body draw tab in a suspended position with the body draw tab extending outward away from the pocket. Another method of drawing the knife is to place the hand or slap the hand onto the pocket so that the little-finger-edge of the palm is located just beneath the exterior body draw tab. Once in position the hand is slid up the pocket allowing the edge of the palm to engage the tab. As the knife is elevated up and out of the pocket, the thumb is moved into place on the opposite side of the blade. The knife is thus removed.

In both scenarios described above, the user orients his hand to an appropriate grip around the knife after the blade is extended. An important aspect of weapon retention in the hand is a strong grip on the handle. Certain features and shapes of handles allow a greater opportunity to establish a strong grip. In the event the gripping hand is wet, the ability to maintain this strong grip is challenged. Any protrusion added to the exterior of a handle, such as a clip, a tab or other structure can be done in a manner that will not compromise the user's ability to establish a strong grip.

A removable knife draw assembly for a folding knife comprising all these features is one embodiment of this invention. All the elements described above, including a clip, a clip draw tab, a body draw tab, a height adjuster, a tensioner and a tensioner pad can be stand-alone components. They can act independently to achieve a more efficient use of a folding knife. Each of the components provides improvement to the operation of the folding knife by themselves or they can work in concert by being brought together into a variety of assemblies to further improve the usability of the folding knife.

According to one aspect, the invention features a removable knife draw assembly for a folding knife. The removable knife draw assembly for a folding knife comprises a removable clip configured to adjustably attach a folding knife attached to the removable clip to a container; and a height adjuster configured to permit adjustment of a position of the folding knife relative to the container.

In one embodiment, the removable knife draw assembly further comprises a clip draw tab configured to be engaged by a hand of a user to assist the user in removing the knife from the container.

In another embodiment, the removable knife draw assembly further comprises a tensioner configured to secure the folding knife in the container with sufficient resistance to prevent accidental dislocation of the knife from the container.

In yet another embodiment, the removable clip is rotatable.

In another embodiment, the removable knife draw assembly further comprises a body draw tab configured to be engaged by a hand of a user to assist the user in removing the knife from the container.

In a further embodiment, the removable clip comprises a platform and a tensioner pad.

According to another aspect, the invention features a removable knife draw assembly for a folding knife. The removable knife draw assembly for a folding knife comprises a removable clip configured to adjustably attach a folding knife attached to the removable clip to a container; and a clip draw tab configured to be engaged by a hand of a user to assist the user in removing the knife from the container.

In a further embodiment, the removable clip is rotatable.

In a further embodiment, the removable knife draw assembly further comprises a tensioner configured to secure the folding knife in the container with sufficient resistance to prevent accidental dislocation of the knife from the container.

In another embodiment, the removable knife draw assembly further comprises a body draw tab configured to be engaged by a hand of a user to assist the user in removing the knife from the container.

In a further embodiment, the removable clip comprises a platform and a tensioner pad.

According to another aspect, the invention relates to a removable knife draw assembly for a folding knife. The removable knife draw assembly for a folding knife comprises a removable clip configured to adjustably attach a folding knife attached to the removable clip to a container; and a tensioner configured to secure the folding knife in the container with sufficient resistance to prevent accidental dislocation of the knife from the container.

In one embodiment, the removable clip is rotatable.

In another embodiment, the removable knife draw assembly further comprises a body draw tab configured to be engaged by a hand of a user to assist the user in removing the knife from the container.

In a further embodiment, the removable clip comprises a platform and a tensioner pad.

According to another aspect, the invention relates to a folding knife, comprising a folding knife having a blade rotatably attached to a handle; and at least one structure selected from the group of structures consisting of a clip configured to adjustably attach a folding knife attached to the removable clip to a container; a height adjuster configured to permit adjustment of a position of the folding knife relative to the container; a clip draw tab configured to be engaged by a hand of a user to assist the user in removing the knife from the container; a tensioner configured to secure the folding knife in the container with sufficient resistance to prevent accidental dislocation of the knife from the container; and a body draw tab configured to be engaged by a hand of a user to assist the user in removing the knife from the container.

Another advantage of the present invention is to provide a folding knife that is safe when stored, and that permits a folding knife to be drawn and to be made ready for use as quickly as a fixed blade knife is drawn, thus realizing a secure, speedy efficient draw. This and other benefits are attained by attaching the aforementioned components, either individually or in any combination thereof.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIG. 7A is a bottom view of a fourth embodiment of the invention showing a removable tab attached to a replacement knife clip in a closed position.

FIG. 7B is a side view thereof.

FIG. 8 is a side view of the fourth embodiment clip.

FIG. 9A is a bottom view, partly exploded, of the fourth embodiment clip and tab in a closed position.

FIG. 9B is a bottom view of the fourth embodiment clip and tab in a deployed position.

FIG. 12A is a bottom view of the invention showing a tab inherently attached.

FIG. 12B is a bottom view of the invention showing a tab inherently attached.

FIG. 12C is a bottom view of the invention showing a tab removably attached.

FIG. 12D is a bottom and side view, exploded, of a removable tab.

FIG. 12E is a bottom and side view, partly exploded, of a clip attachment.

FIG. 18A is a bottom view of the assorted clip draw tab shapes.

FIG. 18B is a bottom view of the threaded, cone-shaped and ball-lock pins.

FIG. 18C is a bottom and side view of the cone-shaped and ball-lock pins secured in a channel.

FIG. 18D is a bottom view of the assorted height adjuster shapes.

FIG. 18E is a bottom view of some assorted tensioner pad shapes.

FIG. 19D is a bottom view of a seventh embodiment of clip assembly.

FIG. 19E is a bottom, zoomed-in view of a seventh embodiment of clip assembly component attachments.

FIG. 22A is a side view of clip draw tab coupler attachment bracket.

FIG. 22B is a top, side, front and cut-out view of a clip draw tab component.

FIG. 22C is an exploded view of clip draw tab coupler assembly.

FIG. 22D is a bottom view of clip draw tab coupler assembly.

FIG. 29A shows a bottom view of a knife, removable platform and modified clip.

FIG. 29B shows an exploded view of a knife, removable platform and modified clip.

FIG. 29C shows a bottom view of a knife, inherent platform and modified clip.

FIG. 29D shows an exploded view of a knife, inherent platform and modified clip.

FIG. 29E shows a bottom view of a knife and removable platform.

FIG. 29F shows a side view of a knife and removable platform.

FIG. 29G shows a bottom view of a knife and inherent platform.

FIG. 29H shows a side view of a knife and inherent platform.

DETAILED DESCRIPTION OF INVENTION

As mentioned, achieving a successful draw and the unfolding of a folding knife while under stress requires training Envision drawing a weapon while managing a physical attack. The isolated routine of a draw is now combined with a multitude of movements which significantly complicate the process. Now envision the requisite skill and composure to unfold the knife. In practice, the draw and unfolding of a folding knife is measured not in seconds, but in fractions of a second. Therefore, a means for enabling the simultaneous drawing and unfolding of a folding knife will increase survivability.

Historically, folding knives have been cumbersome to draw. Their designs have not provided features which afford a secure draw grip. Without gripping features the user's ability to speedily and securely draw the folding knife is significantly reduced. A folding knife with a clip is removed from a pocket using a method comprised of a squeeze or pinch exerted by the thumb and a finger. The thumb is inserted into the pocket while the index finger remains outside. The index finger applies inward pressure against the clip and the thumb applies outward pressure against the knife body which generates ample adhesion between the knife and hand. The knife is then elevated vertically out of the pocket. The resulting compression delivered by the index finger and thumb generates a closing force which is exerted on the material between the clip and the knife body. This in turn generates friction which increases the vertical draw force required to extract the knife. This added force increases the difficulty in achieving a speedy and secure draw. Conventional folding knives lack structures designed for the thumb, fingers and other surfaces of the hand which, when engaged facilitate an efficient draw.

Figure 2:
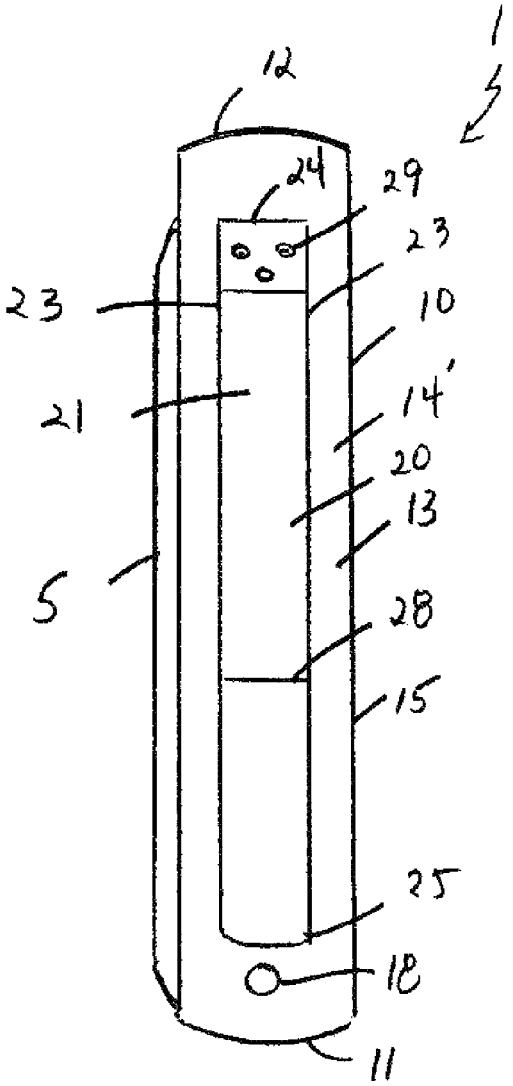
FIG. 2 is a side view thereof.
Figure 1:
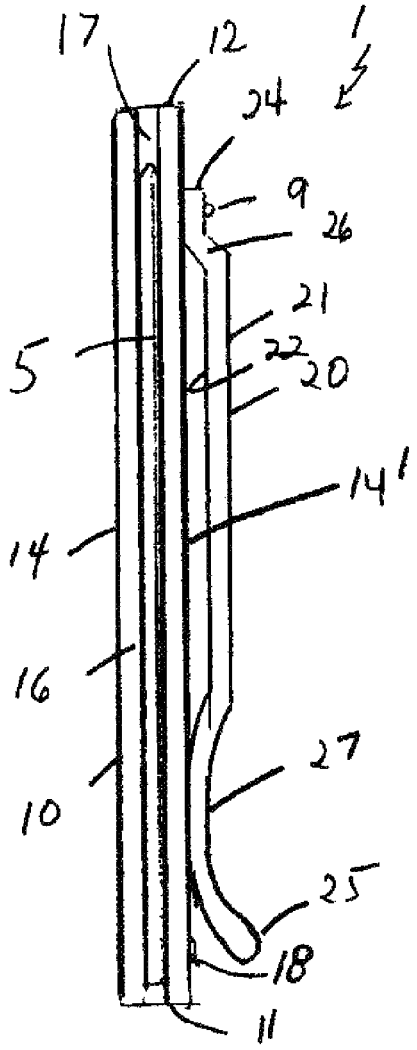
FIG. 1 is a bottom view of a typical clip attachable to a knife handle.

Referring to the drawings, FIGS. 1 and 2 and FIG. 12E in detail, there is shown a typical folding knife 1 comprising a handle 10 and a blade 5 pivotally connected to the handle 10. The handle 10 has a forward end 11, a rear end 12, an elongated body 13 interconnecting the forward and rear ends, the elongated body having two opposite sides 14, 14', a top 15 and a bottom 16, the bottom having an elongated cavity 17 extending from the forward end 11 near to the rear end 12. The handle forward end 11 and rear end 12 define a handle longitudinal axis. The blade 5 is rotatably interconnected to the forward end 11 of the handle by means of a pin 18 that passes through the handle sides 14 near to the handle forward end 11.

The knife 1 is further comprised of an elongated spring-like clip 20, such as a thin metal piece. The clip 20 has an outer side surface 21, and an opposite inner side surface 22 facing the handle side 14'. The clip 20 is further comprised of a bottom edge 23 and top edge 23', a first end 24 and a second end 25, the first and second ends defining a clip longitudinal axis. When attached to a folding knife, the clip longitudinal axis is parallel to the handle longitudinal axis. The clip first end 24 is attached to the handle 10, body 13, side 14' near to the handle rear end 12. The clip first end 24 has one or more apertures 29 formed therein. Fasteners 9, such as machine screws, are inserted through the clip apertures 29 into the threaded apertures 44 (see FIG. 12E) of the handle 10, body 13, side 14' thereby fixedly fastening the clip 20 to the knife. The clip second end 25 terminates near to the handle forward end and is arranged under tension in fixed spaced relationship with respect to the handle side 14' so that a gap is created between the clip inner side surface 22 and handle side 14'. The gap is adapted to slidably receive the thickness of a pocket, holster, or other container so that the knife can be supported by the connector portion 26 on the inside of the clip 22. The connector portion 26 near the clip first end 24 stands the clip 20 away from the handle side 14'. A portion of the clip sides near to the clip second end 25 are typically bent inward toward and usually touching the handle side 14' and then curling outward thereby forming a transverse channel 27 across the clip 20. The channel 27 provides a cinching means for attaching the clip 20 to a pocket, holster or other container. The transverse channel 27 is longitudinally defined by the clip second end 25 and a transverse line 28 longitudinally spaced a designated distance from the clip second end 25 toward the clip first end 24. The clip inner side surface 22, from the connector portion 26 to the transverse line 28, stands away from the handle side 14' forming the gap.

Figure 10:
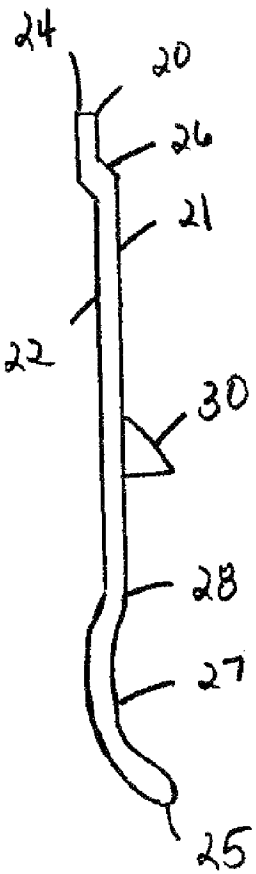
FIG. 10 is a bottom view of a first embodiment of the invention showing a tab formed on the clip.

The modified clip 20' which is a uniquely shaped clip, is further comprised of a clip draw tab 30 shown in FIGS. 10, 12A and 12B, formed through casting, machining or other means as an inherent component of the clip which is located on the clip outer side surface 21. In a first embodiment of the invention the clip draw tab 30 is comprised of a protrusion positioned longitudinally along the clip at a point preferably between the clip connector portion 26 and the clip transverse line 28. See FIGS. 10, 12A and 12B. This cast, machined or by other means formed feature can be formed as an integral aspect of a clip but the overall shape of the clip which the tab can be formed out of, can be designed to match an existing clip that does not contain the clip draw tab feature. The user will remove the existing clip, for example, by unscrewing the screws 42 shown in FIG. 12E from clip apertures 29 and knife body 10 threaded apertures 44 and replace it with the clip draw tab clip in a reverse manner.

The clip 20, to be comprised of a clip draw tab, may be drilled to form one or more apertures which will receive a removably attachable clip draw tab. The clip may also be a modified clip 20' which is designed and formed or shaped with apertures or other attachment means with the intent of receiving clip draw tabs or other components. FIGS. 12C and 12D show a removably attachable clip draw tab 30. In one example, the clip draw tab 30 is centered over the aperture 40 FIG. 12D. The machine screw is inserted into the clip from the inner side surface 22 through aperture 40 and into the threaded aperture 30*a* of clip draw tab 30.

Figure 4B:
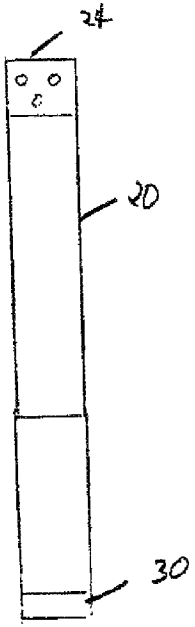
FIG. 4B is a side view thereof.
Figure 4A:
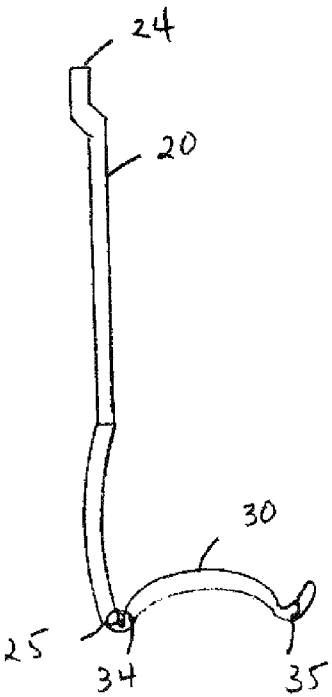
FIG. 4A is a bottom view of the embodiment shown in FIG. 3A showing the tab in a deployed position.
Figure 3B:
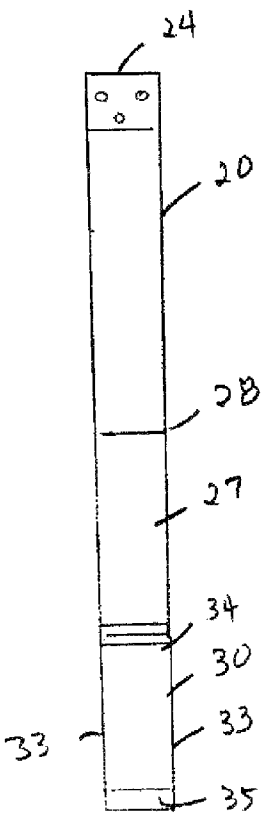
FIG. 3B is a side view thereof.
Figure 3A:
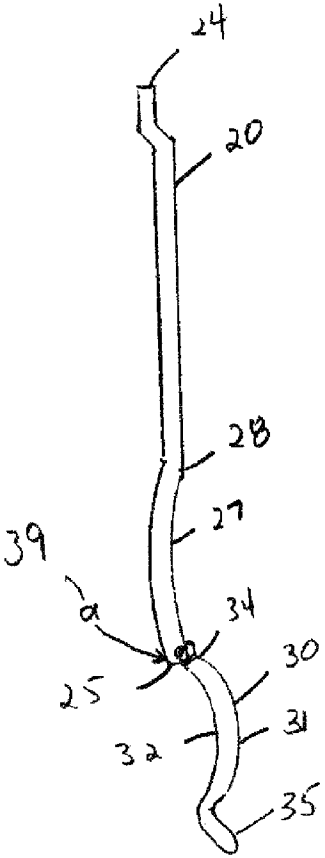
FIG. 3A is a bottom view of a second embodiment of the invention showing a tab attached one end of a knife clip in a closed position.

Referring to FIGS. 3A, 3B, 4A and 4B, in another embodiment of the invention, the clip draw tab 30 has an outer side surface 31, an opposite inner side surface 32, a bottom edge 33 and an opposite top edge 33', a first end 34 and a second end 35, the first and second ends defining a tab longitudinal axis. The tab first end 34 is pivotally attached to clip second end 25. The clip draw tab 30 has two positions, a closed position as shown in FIGS. 3A and 3B, wherein the tab longitudinal axis forms an elongated clip and is parallel to the clip longitudinal axis, and a deployed position as shown in FIGS. 4A and 4B wherein the tab longitudinal axis is perpendicular to the clip longitudinal axis. The clip draw tab 30 is inhibited from extending more that 90° from the clip longitudinal axis.

Figure 6B:
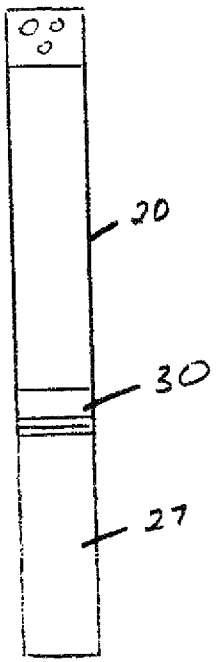
FIG. 6B is a side view thereof.
Figure 6A:
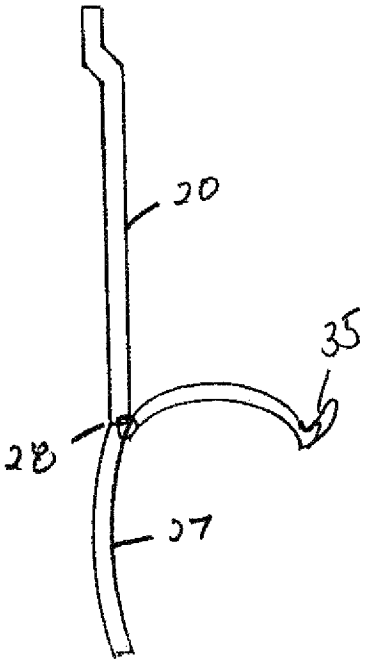
FIG. 6A is a bottom view of the embodiment shown in FIG. 5A with the tab in a deployed position.
Figure 5B:
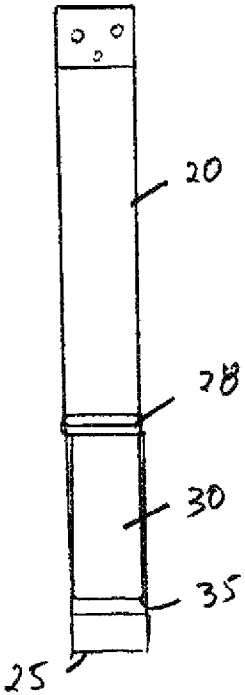
FIG. 5B is a side view thereof.
Figure 5A:
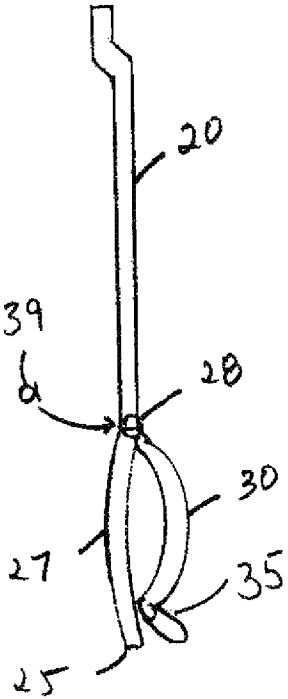
FIG. 5A is a bottom view of a third embodiment of the invention showing a tab attached to a knife clip in a closed position.
Figure 11B:
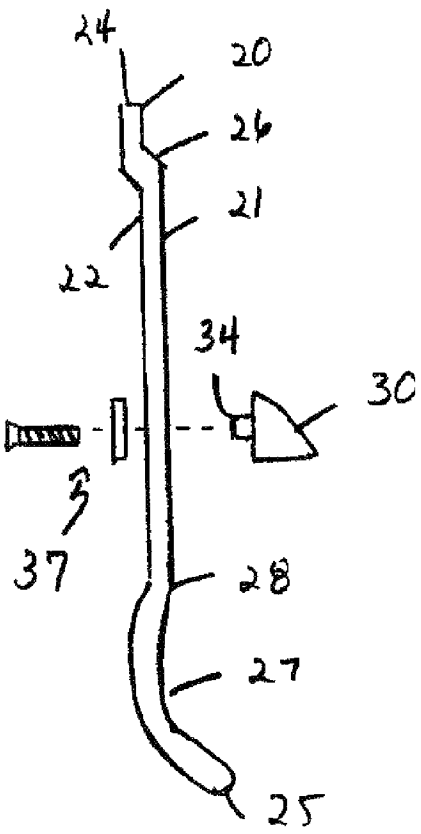
FIG. 11B is a bottom view, partly exploded, of a removable tab.
Figure 11A:
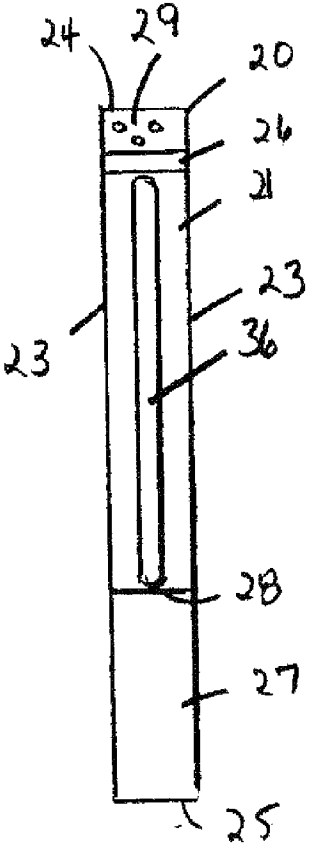
FIG. 11A is a side view of a clip modified for a removable tab.

In another embodiment of the invention shown in FIGS. 5A, 5B, 6A and 6B, the tab first end 34 is pivotally attached to the modified clip 20' at the clip transverse line 28. The clip draw tab 30 has two positions, a closed position as shown in FIGS. 5A and 5B, wherein the tab longitudinal axis is parallel to the clip longitudinal axis and a deployed position as shown in FIGS. 6A and 6B wherein the tab longitudinal axis is perpendicular to the clip longitudinal axis.

In still another embodiment of the invention as shown in FIGS. 7A, 7B, 8, 9A and 9B, the tab first end 34 is pivotally and adjustably attached to a longitudinal channel 36 formed centrally in the clip side surfaces extending through the outer side surface 21 and opening through the inner side surface 22. The longitudinal channel 36 extends from the clip connector portion 26 to the clip transverse line 28. The tab first end 34 terminates in connector means 37 permitting the tab first end 34 to be attached at any desired point along the clip longitudinal channel 36.

The tab first end 34 may be spring-loaded to hold the clip draw tab 30 in a closed position as a default position, shown in FIGS. 5A and 7A. In the default position, a retention spring 39 will hold the clip draw tab 30 against the clip outer side surface 21.

The first embodiment of the clip assembly 46 shown in FIGS. 13A, 14A, 14C and 14D is comprised of a modified clip 20', a clip draw tab 30, a tensioner pad 45, a platform 47, a tensioner bolt 59 and a compressible bushing 62. The platform 47 is attached to the body 13, side 14' at the rear end 12 of the handle 10. One method of attachment is to utilize machine screws 54 inserted through the platform apertures 51 into the handle 10. The platform 47 can be mounted on footprint 65. The machine screws 54 can be threaded into the threaded apertures 64. Another aperture 63 forms a relief for the tensioner bolt 59 if it is tightened beyond the limits of the platform base. Another method would be to inherently form the platform into the body 13, side 14' of the handle 10. The first end 24 of a modified clip 20' is oriented with the inner side surface 22 in contact with the aperture 53 surface of the platform 47 so that the longitudinal axis of a modified clip 20' is parallel with the longitudinal axis of the handle 10. A modified clip 20' is then secured in place with machined screws 54 through apertures 55 and into threaded apertures 53 of the platform 47. The tensioner bolt 59 is then inserted into aperture 60 on a modified clip 20' and through the compressible bushing 62 and into the threaded aperture 52. The aperture 57 end of the tensioner pad 45 is then positioned at the second end 25 and inner side surface 22 of a modified clip 20'. The tensioner pad 45 is then secured in place with machined screws 54 through apertures 56 and into threaded apertures 57. The tensioner bolt 59 can be tightened to achieve the optimal pressure on the base of the tensioner pad 45. The spacer washers 58 may be added to the tensioner bolt above outer side surface 21 of a modified clip 20' to further increase pressure on the base of the tensioner pad 45.

Figures 13A, 13B, 13C, 13D, 13E:
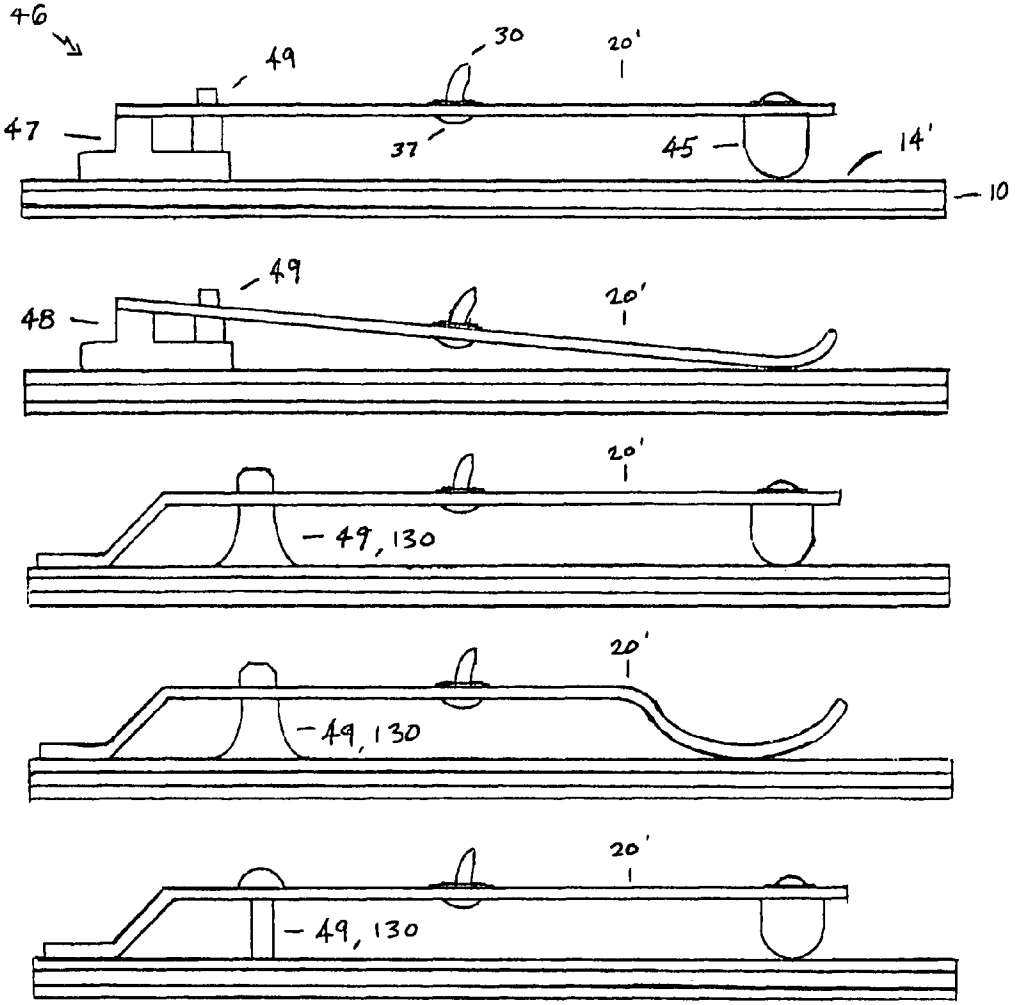
FIG. 13A is a bottom view, of the first embodiment of the clip assembly.
FIG. 13B is a bottom view, of a second embodiment of the clip assembly.
FIG. 13C is a bottom view, of a third embodiment of the clip assembly.
FIG. 13D is a bottom view, of a fourth embodiment of the clip assembly.
FIG. 13E is a bottom view, of a fifth embodiment of the clip assembly.
Figures 14A, 14B, 14C, 14D:
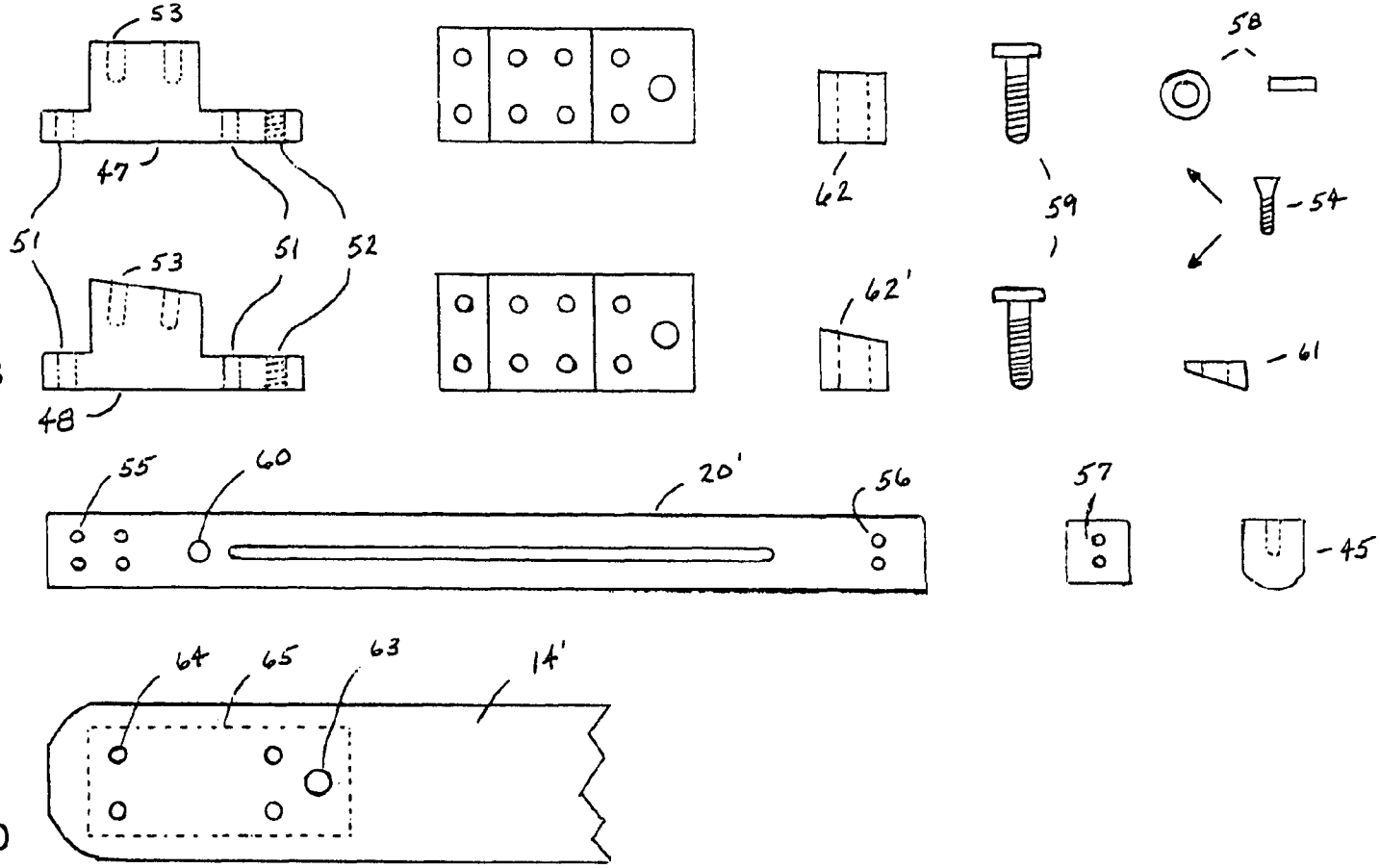
FIG. 14A is a bottom and side view of the first embodiment of the clip assembly components.
FIG. 14B is a bottom and side view of the second embodiment of the clip assembly components.
FIG. 14C is a bottom and side view of the first and second embodiment of the clip assembly components.
FIG. 14D is a side view of the second embodiment of a clip assembly component.
Figures 15A, 15B, 15C, 15D, 15E:
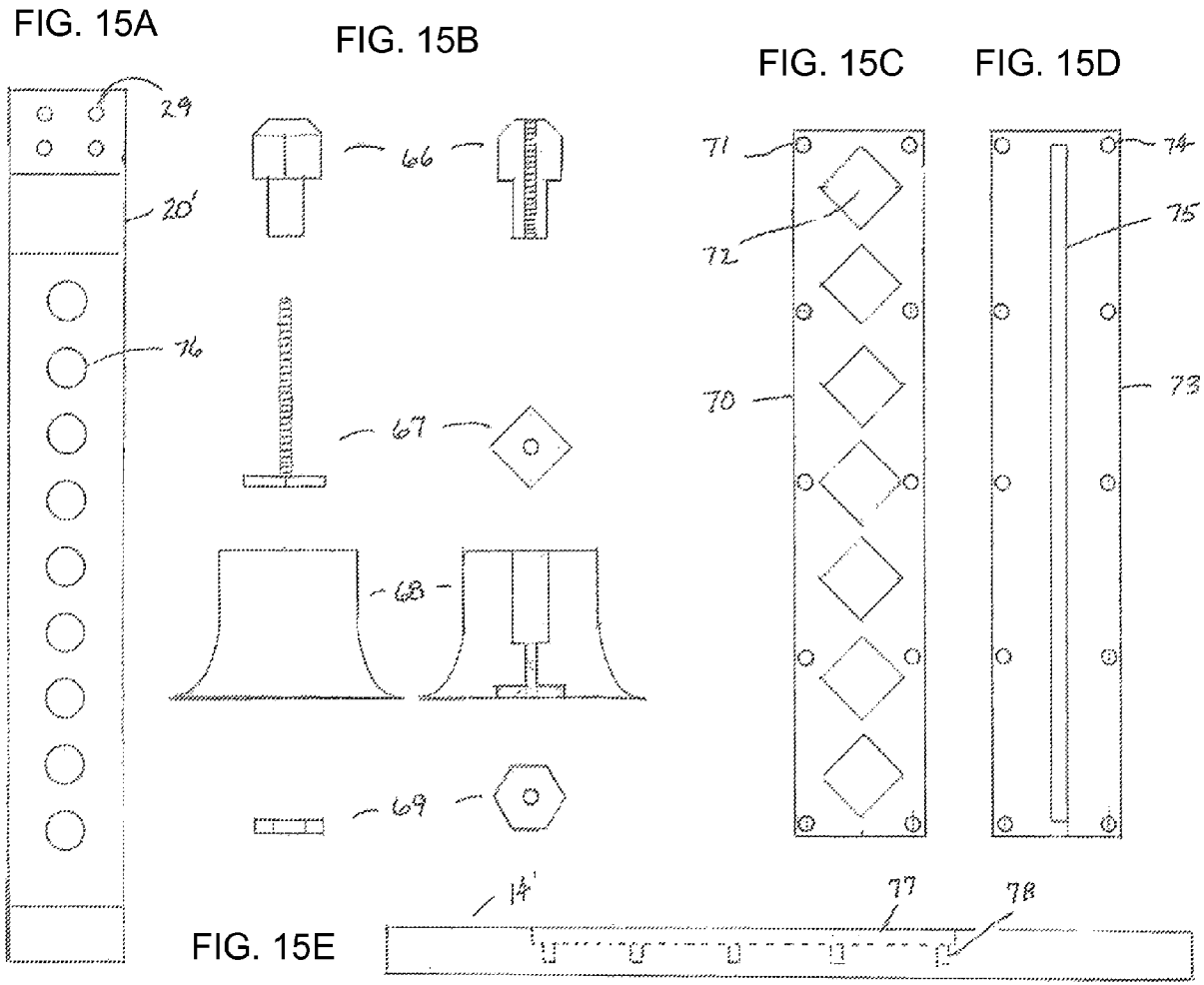
FIG. 15A is a side view of a modified clip.
FIG. 15B is a bottom and side view of the third embodiment of the clip assembly components.
FIG. 15C is a side view of the third and fourth embodiment of a clip assembly component.
FIG. 15D is a side view of the third and fourth embodiment of a clip assembly component.
FIG. 15E is a bottom view of the third and fourth embodiment of a clip assembly component.

The second embodiment of the clip assembly 46 shown in FIGS. 13B, 14B, 14C and 14D is comprised of the same components as the first embodiment with the following exceptions: the platform 48 surface containing apertures 53 in FIG. 14B is sloping from the rear end 12 toward the forward end 11 of the handle 10 so that the inner side surface 22 at the second end 25 of a modified clip 20' is in contact with side 14'. The wedge 61 is placed between the tensioner bolt 59 and the outer side surface 21 of a modified clip 20' to obtain proper tensioner bolt contact with the clip and washers. A modified clip 20' may use a tensioner pad, but does not utilize one in this depiction. The modified clip shown here is bent outward away from side 14' at the second end 25 as shown in FIG. 13B. The tensioner bolt 59 can be tightened to achieve the optimal pressure on the inner side surface 22 near second end 25 that contacts side 14'. Compressible bushing 62' is utilized instead of compressible bushing 62.

The third embodiment of the clip assembly 46 and contains a height adjuster and tensioner 49, shown in FIGS. 12E, 13C, 15A-15E, 16C, 16F, 17A, 18A and 18B is comprised of a modified clip 20', a clip draw tab 30, a tensioner pad 45, a square head bolt 67, a tensioner nut 66, a tensioner bolt head plate 70, a tensioner bolt channel plate 73, a set nut 69 and a compressible bushing 68. Tensioner bolt head plate 70 which lies beneath tensioner bolt channel plate 73 can be surface mounted with tapered edges similar to the clip shown in FIG. 16C or may be recess mounted into the body 13 of the handle 10, similar to the clip shown in FIG. 16F. In the bottom view shown in FIG. 15E a recess is formed into the body 13 of side 14' of the handle 10. The recess 77 is shaped to receive plates 70 and 73 so that threaded apertures 78 align with apertures 71 and 74. The longitudinal axis of both the tensioner bolt head plate and channel plate lay parallel to the longitudinal axis of the handle. Prior to placing the channel 75 of the tensioner bolt channel plate 73 over the tensioner bolt head plate 70, the square head bolt 67 is fit into one of the available squares 72 located in the tensioner bolt head plate 70. Once both plates and the square head bolt are in place, machine screws 54, are inserted through the plate apertures 71 and 74 and secured in threaded apertures 78. The set nut 69 is threaded onto the square head bolt 67 and tightened. The compressible bushing 68 is then placed over the square head bolt 67. A modified clip 20' first end 24 is placed, so as to properly align the apertures 29 with the threaded apertures 44 FIG. 12E in the knife handle side 14' near rear end 12, and to properly align the appropriate clip tensioner and height adjuster aperture 76 over the square head bolt. Machine screws 54, are inserted through the clip apertures 29 into the threaded apertures 44 in the knife handle 10, body 13, side 14' thereby fixedly fastening a modified clip 20' to the knife handle 10. The tensioner nut 66 is then threaded onto the square head bolt 67. The aperture 57 end (FIG. 14C) of the tensioner pad 45 is then positioned at the second end 25 and inner side surface 22 of a modified clip 20'. The tensioner pad 45 is then secured in place with machined screws 54 through apertures 56 and into threaded apertures 57. The tensioner nut 66 with or without spacer washers can be tightened to achieve the optimal pressure on the base of the tensioner pad 45. The tensioner nut can also be fitted or formed with clip draw tab shapes shown in FIGS. 18A and 18B as a knife-draw-tab-tensioner-nut-combination 119 FIG. 18B.

The fourth embodiment of the clip assembly 46 shown in FIG. 13D is identical to that of embodiment three except that it uses a modified clip 20' with tensioner and height adjuster apertures 76 formed therein but no tensioner pad 45.

Figure 16A:
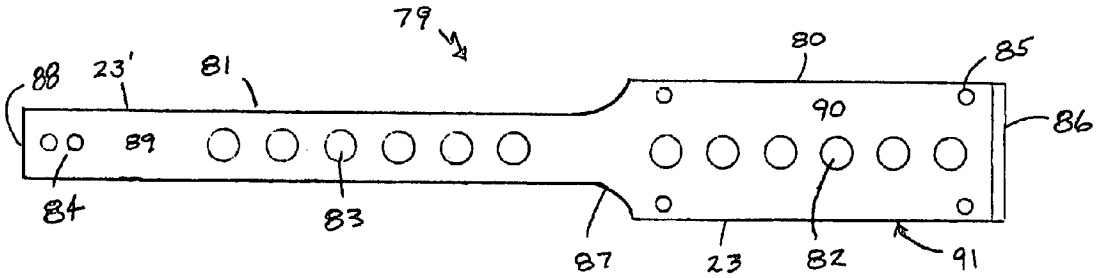
FIG. 16A is a side view of the clip-plate combination in unbent form.
Figure 16B:
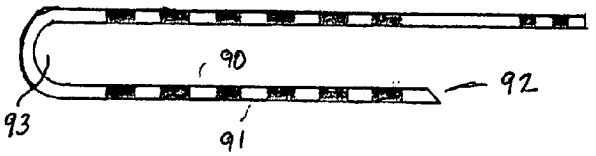
FIG. 16B is a bottom view of the clip-plate combination in bent form.
Figure 16C:
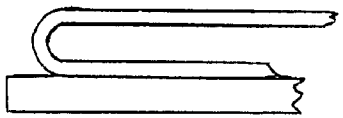
FIG. 16C is a bottom view of the clip-plate combination in bent form, surface mounted.
Figure 16D:
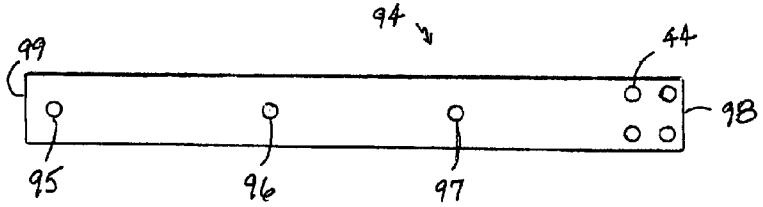
FIG. 16D is a side view of a modified clip in unbent form.
Figure 16E:
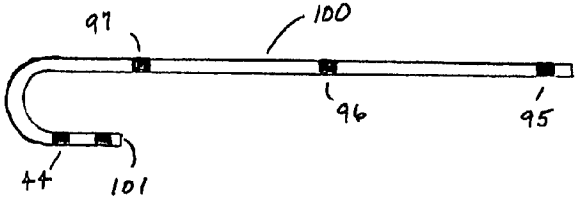
FIG. 16E is a bottom view of a modified clip in bent form.
Figure 16F:
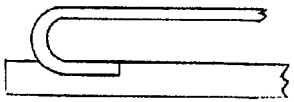
FIG. 16F is a bottom view of a modified clip in bent form, recess mounted.
Figure 24A:
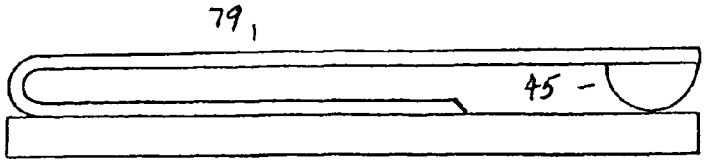
FIG. 24A is a bottom view, of the fifth embodiment of the clip assembly with clip-plate combination with tensioner pad.
Figure 24B:
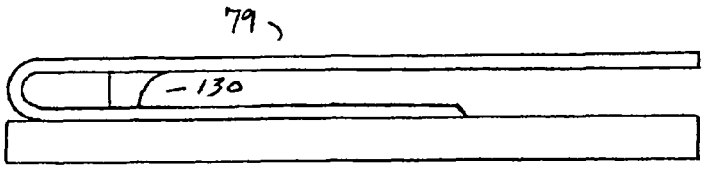
FIG. 24B is a bottom view, of the fifth embodiment of the clip assembly with clip-plate combination with height adjuster.
Figure 24C:
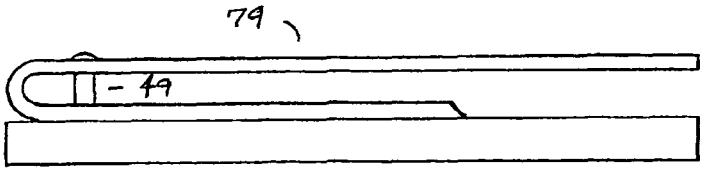
FIG. 24C is a bottom view, of the fifth embodiment of the clip assembly with clip-plate combination with tensioner.
Figure 24D:
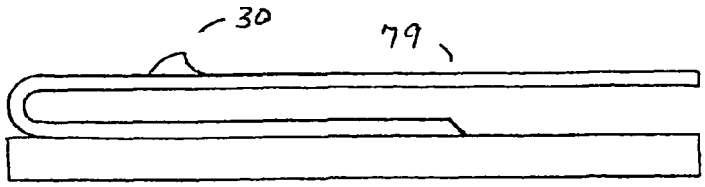
FIG. 24D is a bottom view, of the fifth embodiment of the clip assembly with clip-plate combination with clip draw tab.
Figure 24E:
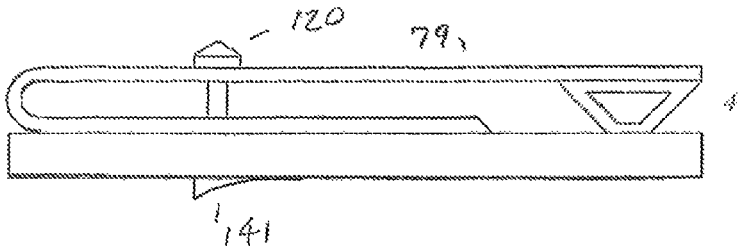
FIG. 24E is a bottom view, of the fifth embodiment of the clip assembly with clip-plate combination with tensioner pad, clip-draw-tab-height-adjuster-tensioner-combination and body draw tab.
Figure 24F:
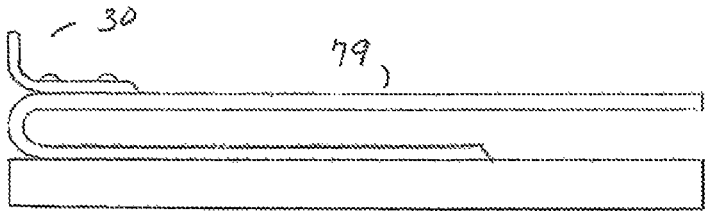
FIG. 24F is a bottom view, of the fifth embodiment of the clip assembly with clip-plate combination with clip draw tab.
Figure 24G:
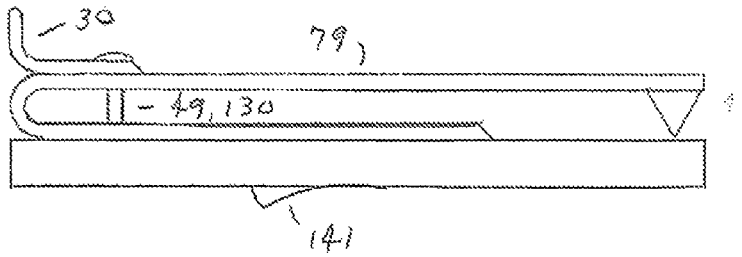
FIG. 24G is a bottom view, of the fifth embodiment of the clip assembly with clip-plate combination with tensioner pad, height adjuster, tensioner, clip draw tab and body draw tab.
Figure 24H:
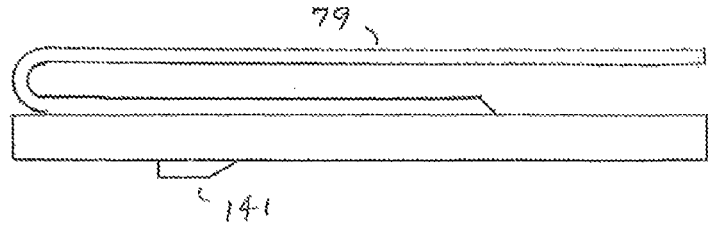
FIG. 24H is a bottom view, of the fifth embodiment of the clip assembly with clip-plate combination with body draw tab.
Figure 25A:
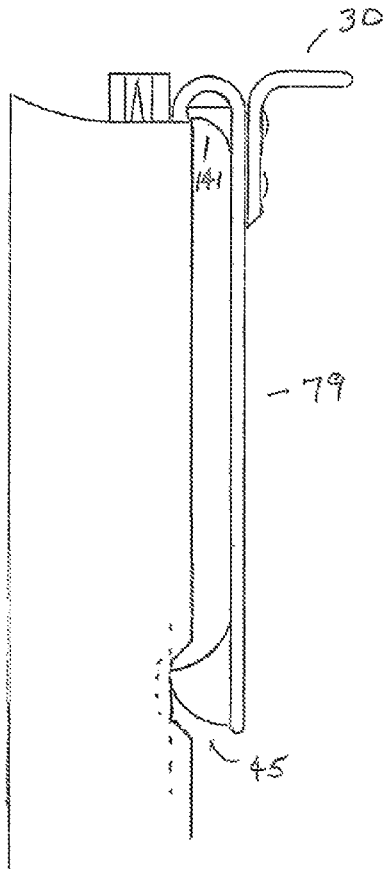
FIG. 25A shows a bottom view of a clip-plate combination, with a tensioner pad, a clip draw tab, and a height adjuster.
Figure 25B:
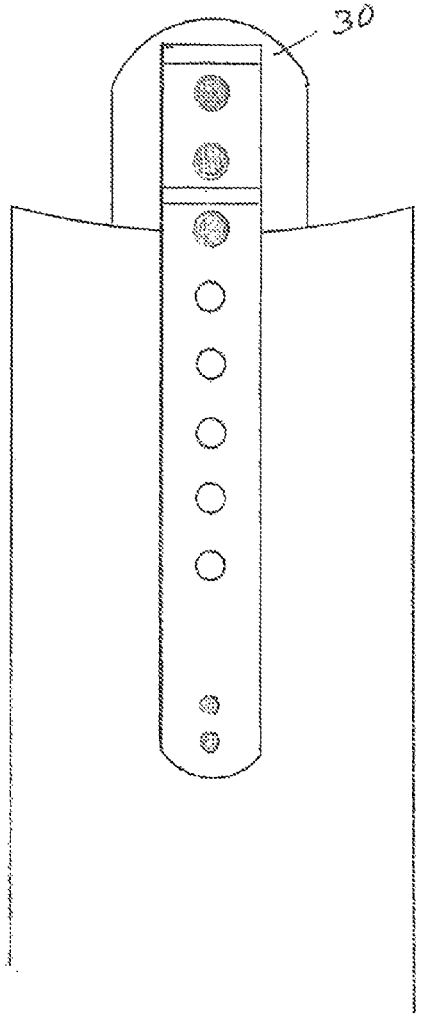
FIG. 25B shows a side view of a clip-plate combination, with a tensioner pad, a clip draw tab, and a height adjuster.

The fifth embodiment of the clip assembly 46 and contains a height adjuster and tensioner 49, shown in FIGS. 12E, 13E, 15E, 16A-16F, 17A-17C, 18A-18C, 24A-24H, 25A-25B and is comprised of a clip-plate combination 79, a modified clip 20', a clip draw tab 30, a tensioner pad 45, a threaded pin 105, a cone-tipped pin 108, a ball-lock pin 123, a tensioner plate 102, spacer washers 111, and a clip-draw-tab-height-adjuster-tensioner-combination 120. The threaded pin 105, cone-tipped pin 108 and the ball-lock pin 123 are used in conjunction with the clip-plate combination 79 to provide a fourfold purpose. The assembly provides a removable clip to adjustably position the folding knife to a pocket, holster or other container, the removable clip having a clip draw tab to remove the knife from the container, a height adjuster to position the folding knife in the container and a tensioning mechanism to secure the folding knife in the container with the proper resistance. The arrangement of components can be organized to facilitate this outcome in many combinations. The clip-plate combination 79 as shown in FIG. 16A can be formed out of a piece of high-elasticity sheet metal. The clip-plate combination 79 has a base plate 80, a flared segment 87 and an elevated plate 81. The sheet metal structure can be punched-out of a dye, and the apertures 82, 83, 84 and 85 can also be punch formed. The base plate 80 apertures 82 which lie between top edge 23' and bottom edge 23 along the longitudinal axis extending from flared segment 87 to base plate termination 86 are thread dye-tapped. The base plate termination 86 may be tapered as in end 92 for a surface mount as shown in FIGS. 16A-16C or may be flat as in end 101 for a recess mount as shown in FIGS. 16D-16F. The clip-plate combination 79 is then bent into clip shape by folding elevated plate 81 about flared segment 87 so that flat surface 89 and flat surface 90 are opposite each other. A transverse channel 93 is formed at the flared segment 87. This transverse channel runs from bottom edge 23 to top edge 23' and is perpendicular to the longitudinal axis of the clip-plate combination 79. The bending process is completed when elevated plate 81 and base plate 80 are parallel to each other and threaded base plate 80 apertures 82 and elevated plate 81 apertures 83 are concentrically aligned assuring that the base plate 80 aperture 82 closest to base plate termination 86 is cylindrical-wall-collinear to the elevated plate 81 aperture 83 closest to the elevated plate termination 88, as shown in FIG. 16B. Machine screws 54, are inserted through the base plate 80 apertures 85 into the threaded apertures similar to apertures 78 shown in FIG. 15E in the knife handle 10, body 13, side 14' thereby fixedly fastening the clip-plate combination 79 to the knife handle 10. One unique feature of clip-plate combination 79 is that plates 70, 73, and 102 shown in FIGS. 15C, 15D and 17A as well as modified clips 20' shown in FIGS. 13A-13E, 15A, and 17A are combined into one structure. The base plate 80 described above contains threaded apertures 82 which will receive the threaded ends 106 of threaded pins 105 and 107, and hold them fixed in place. This is one aperture design for the base plate 80. Another design involves the use of spring loaded retainers 114 formed beneath unthreaded apertures 82. One example of this is the use of high elasticity metal rods. Two rods 115 (FIG. 17C) are positioned along the longitudinal axis of the clip-plate combination 79. The rods are positioned so they are visible within the apertures 82 and spaced so as to form parallel rails. The rails are fixed by tack-welding 117 or other anchoring method to the base plate 80, flat surface 91, opposite flat surface 90. The gap established between the rails is flexibly rigid. They will elastically deform to receive a slot 109 formed between the pin main body and the cone of the cone-tipped pin 108 and then remain rigid, holding the pin in place. Slots 116 are formed on each side of the apertures 82. Spreader tools 118 are inserted in each slot 116 adjacent to the pinned aperture. The rods are separated beyond the extent of the pin's cone and the cone-tipped pin 108 can be removed. A spacer plate (not shown) is used with the rods to keep them from contacting the body of the knife. A third design uses a simple punched-hole aperture 82 and a spring loaded ball-lock pin 123. The protruding ball 125 is released inward when the button 124 is pressed thus allowing the ball-lock pin 123 to be inserted in the aperture 82. Once the depth of the pin in the aperture is adequate for the ball to reside beneath the flat surface 91, the button 124 is released and the ball is forced outward, thus rigidly holding the pin in place. The pins described above are used to provide three of the four, fourfold purposes of the fifth embodiment of the clip assembly 46. The pins are placed through an aperture 83 in the elevated plate 81 down into a corresponding base plate 80 aperture 82. Threaded receiving aperture 112, rod receiving aperture 113 and simple punched-hole aperture 82 hold the pins securely in place. The pin length and number of spacer washers 111 chosen determines the tension at which the tensioner pad 45 rests against the body 13, side 14' of the handle 10. For example, pins 107, 110 and a shorter version of 123 (not shown) are shorter and once in place will exert a greater force on the clip. The particular aperture column 82 and 83 with respect to elevated plate termination 88 where the pin is inserted determines the height at which the folding knife rests in the pocket, holster or other container. The particular head selected from FIG. 18A formed as an integral feature of the pin, regardless of anchoring method, 106 for pin 122, 109 for pin 121 or 125 for pin 123, establishes a knife-draw-tab-height-adjuster-tensioner-combination 120. This combination pin adds the clip draw tab thus completing the third component of the three provided by the pins. The clip itself provides the fourth component of the fourfold purpose of the fifth embodiment of the clip assembly 46. An added feature for use with certain clip draw tabs that are not symmetrically shaped but are integral to the cone-slotted pin 121 and the ball-lock pin 123 as in the clip-draw-tab-height-adjuster-tensioner-combination, is an added channel system 126 to be mounted to the outer side surface of the clip 21, one along the bottom edge 23 and another along the top edge 23', running from the connector portion 26 to the transverse line 18 or the tensioner pad 45 aligned with the clip longitudinal axis. The base 128 of the head of the pin is flattened on two opposite edges so that as the pin is inserted between the walls of the channel system 126 to rest against the reduced surface 127 of outer side surface 21 of a modified clip 20', the clip draw tab aspect is properly oriented and held fixedly in the orientation. Without this channel the pin may spin in place when contacted. For use with a symmetric clip draw tab where any orientation that the tab faces is the same, for instance, a semi-sphere or inverted cone the use of the channel is unnecessary. FIG. 24A shows a clip-plate combination 79 outfitted with a tensioner pad 45. FIG. 24B shows a clip-plate combination 79 outfitted with a height adjuster 130. FIG. 24C shows a clip-plate combination 79 outfitted with a tensioner 49. FIG. 24D shows a clip-plate combination 79 outfitted with a clip draw tab 30. FIG. 24E shows a clip-plate combination 79 outfitted with a tensioner pad 45, clip-draw-tab-height-adjuster-tensioner-combination 120 and a body draw tab 141. FIG. 24F shows a clip-plate combination 79 outfitted with a clip draw tab 30. FIG. 24G shows a clip-plate combination 79 outfitted with a tensioner pad 45, a clip draw tab 30, a tensioner 49, a height adjuster 130 and a body draw tab 141. FIG. 24H shows a clip-plate combination 79 outfitted with a body draw tab 30. FIG. 25A shows a bottom view of a clip-plate combination 79 outfitted with a tensioner pad 45, a clip draw tab 30, and a height adjuster 141. FIG. 25B shows a side view of the same configuration but in this view the height adjuster has been repositioned to the third hole down from the top of the clip which is evident by the elevated resting position of the knife.

Figure 17A:
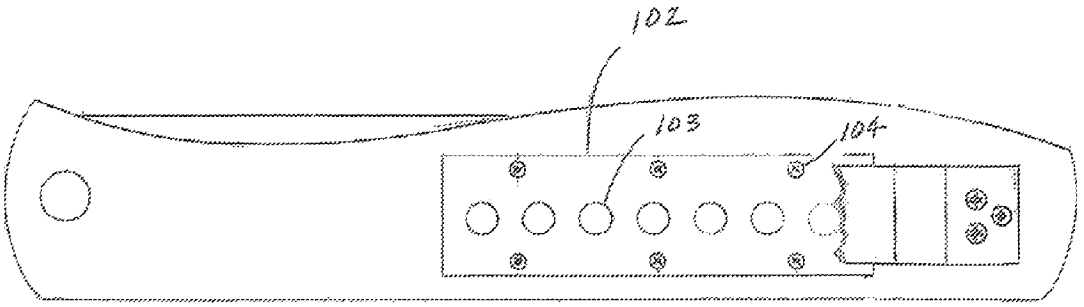
FIG. 17A is a side view of a modified clip and tensioner plate in bent form depicted partially cutaway on the knife.
Figure 17B:
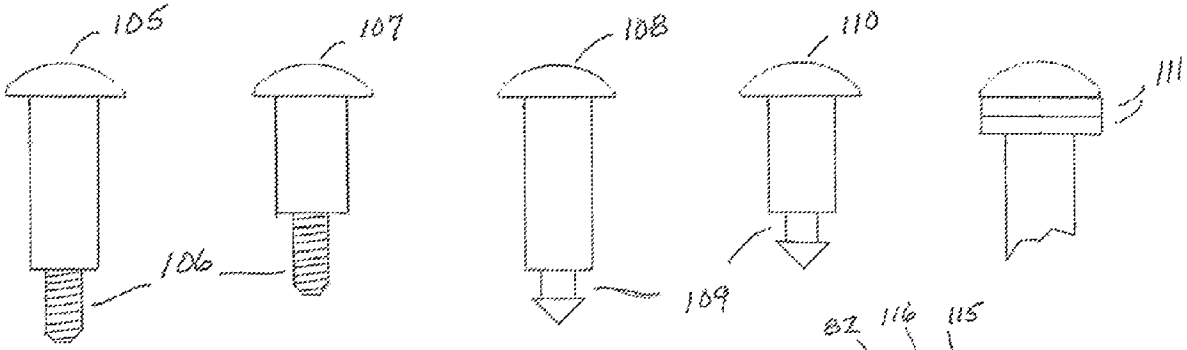
FIG. 17B is a bottom view of the threaded and cone-shaped pins.
Figure 17C:
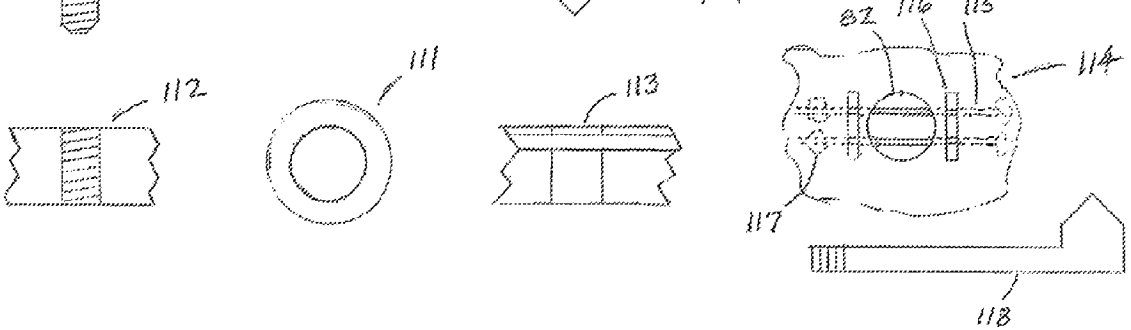
FIG. 17C is a bottom and side view of the sixth embodiment of the clip assembly components.

The sixth embodiment of the clip assembly 46 shown in FIGS. 12E, 13E, 16D-16F, 17A-17C, 18A-18C and is comprised of a platform 29*b*-1 shown in FIG. 29B or 29*d*-1 in FIG. 29D, a modified clip 94, a modified clip 20', a clip draw tab 30, a tensioner pad 45, a threaded pin 105, a cone-shaped pin 108, a ball-lock pin 123, a tensioner plate 102, spacer washers 111, and a knife-draw-tab-height-adjuster-tensioner-combination 120. The components of this embodiment are the same as those in the fifth embodiment of the clip assembly 46 except that the clip-plate combination 79 is not used and modified clips 20' and 94 are. The plate and clip alignment and mounting format is as described in the third embodiment of the clip assembly 46. A side view of this configuration is shown in FIG. 17A, whereas a bottom view is displayed in FIG. 13E. The elevated plate 100 of modified clip 94 can have apertures (not shown) formed that are aligned to mate with a corresponding tensioner plate 102 apertures 103, which can be configured to secure a pin similar to the way clip-plate combination 79 base plate 80 apertures 82 are configured. The tensioner plate 102 can be surface mounted with a tapered end or recess mounted with a flat end. The tensioner plate has blank apertures 104 or threaded apertures 112 and threaded screws 54 or it also can be fitted with rods 115. Assembled with the knife-draw-tab-height-adjuster-tensioner-combination 120, this structure will also generate the fourfold purpose of the clip assembly 46. In addition a platform FIG. 29B-1 or 29D-1 and modified clip 20' or 94 can be utilized as a mounting variation.

Figures 19A, 19B, 19C:
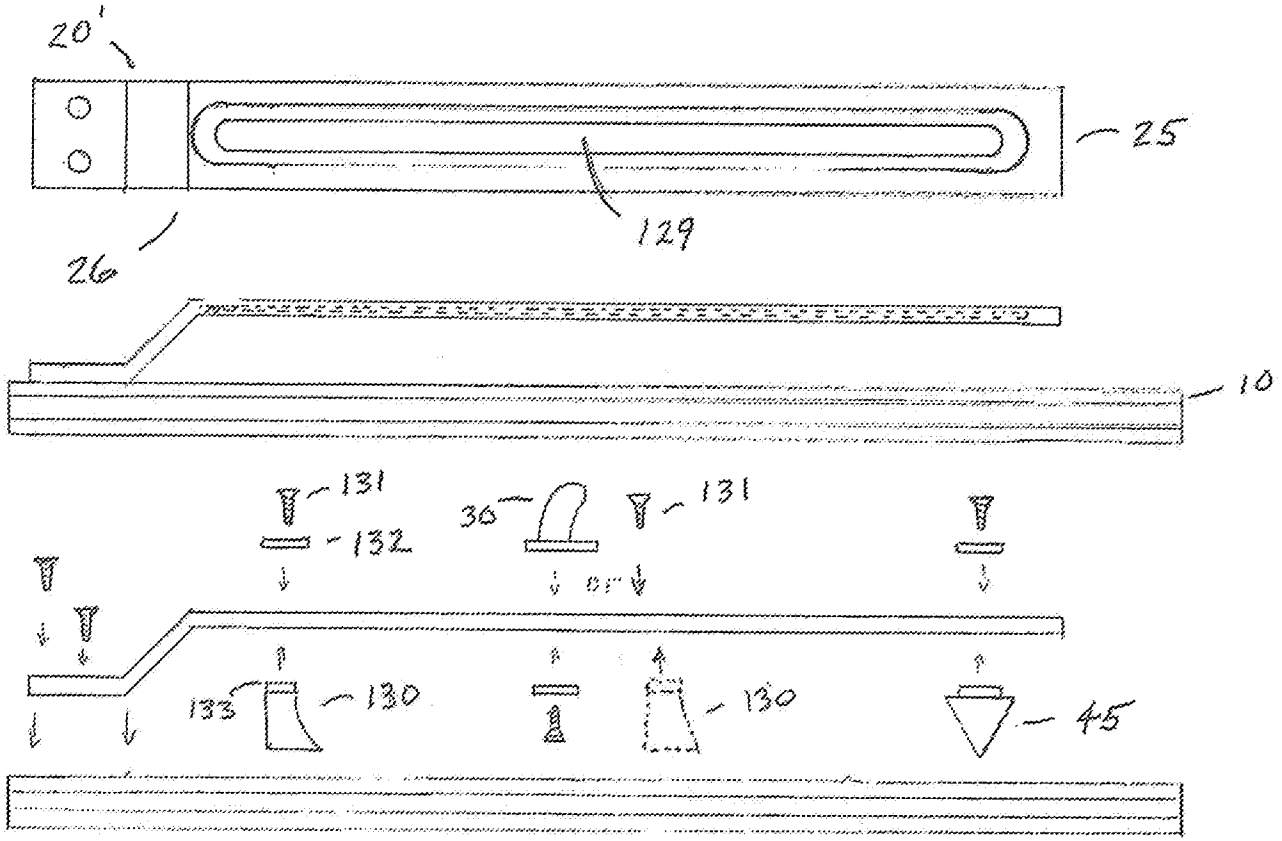
FIG. 19A is a side view of a modified clip with a channel.
FIG. 19B is a bottom view of a seventh embodiment of clip assembly knife and clip.
FIG. 19C is a bottom view, exploded of a seventh embodiment of clip assembly.
Figure 20D:
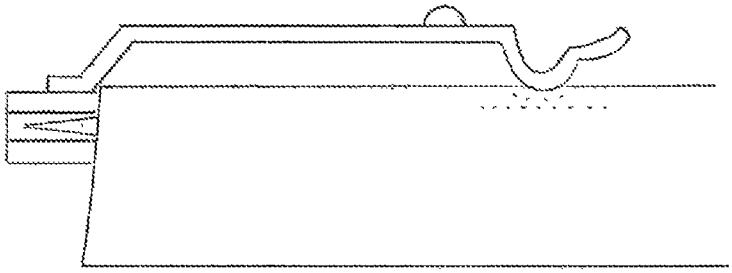
FIG. 20D is a bottom view of a clip in a container.
Figure 20C:
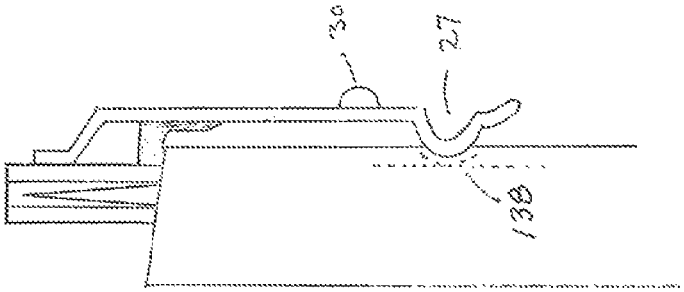
FIG. 20C is a bottom view of a clip with height adjuster in a container.
Figure 20B:
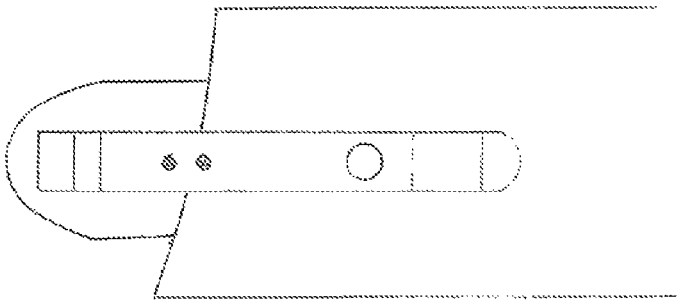
FIG. 20B is a side view of a clip with height adjuster in a container.
Figure 20A:
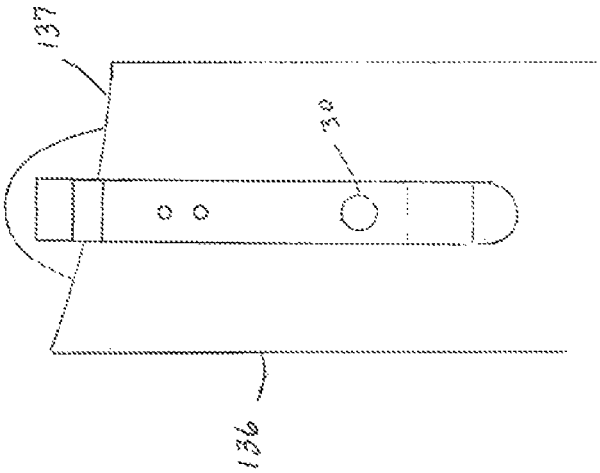
FIG. 20A is a side view of a clip in a container.
Figure 20H:
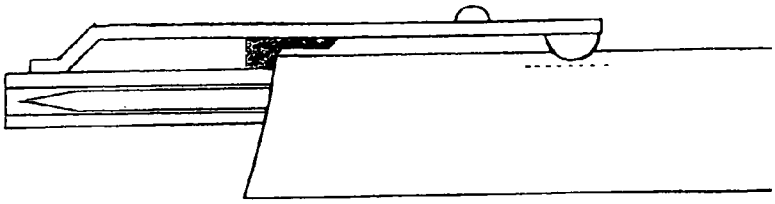
FIG. 20H is a bottom view of a clip with height adjuster in a container.
Figure 20G:
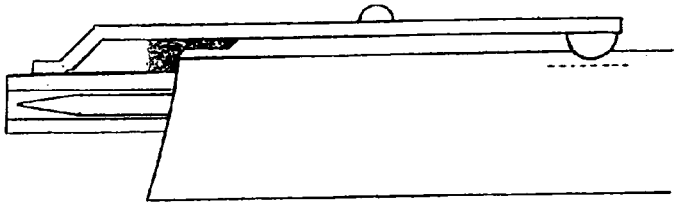
FIG. 20G is a bottom view of a clip with height adjuster in a container.
Figure 20F:
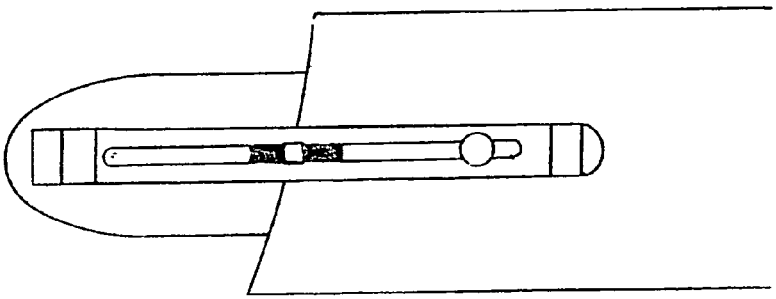
FIG. 20F is a side view of a clip with height adjuster in a container.
Figure 20E:
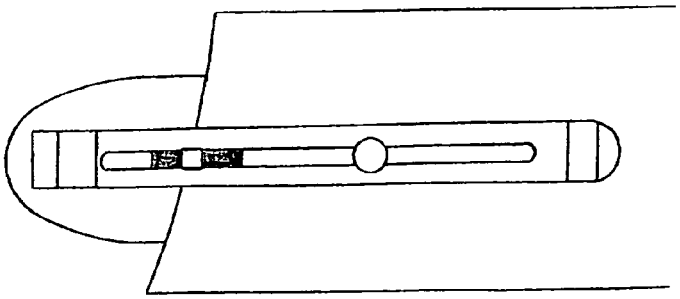
FIG. 20E is a side view of a clip with height adjuster in a container.
Figures 28A, 28B, 28C, 28D:
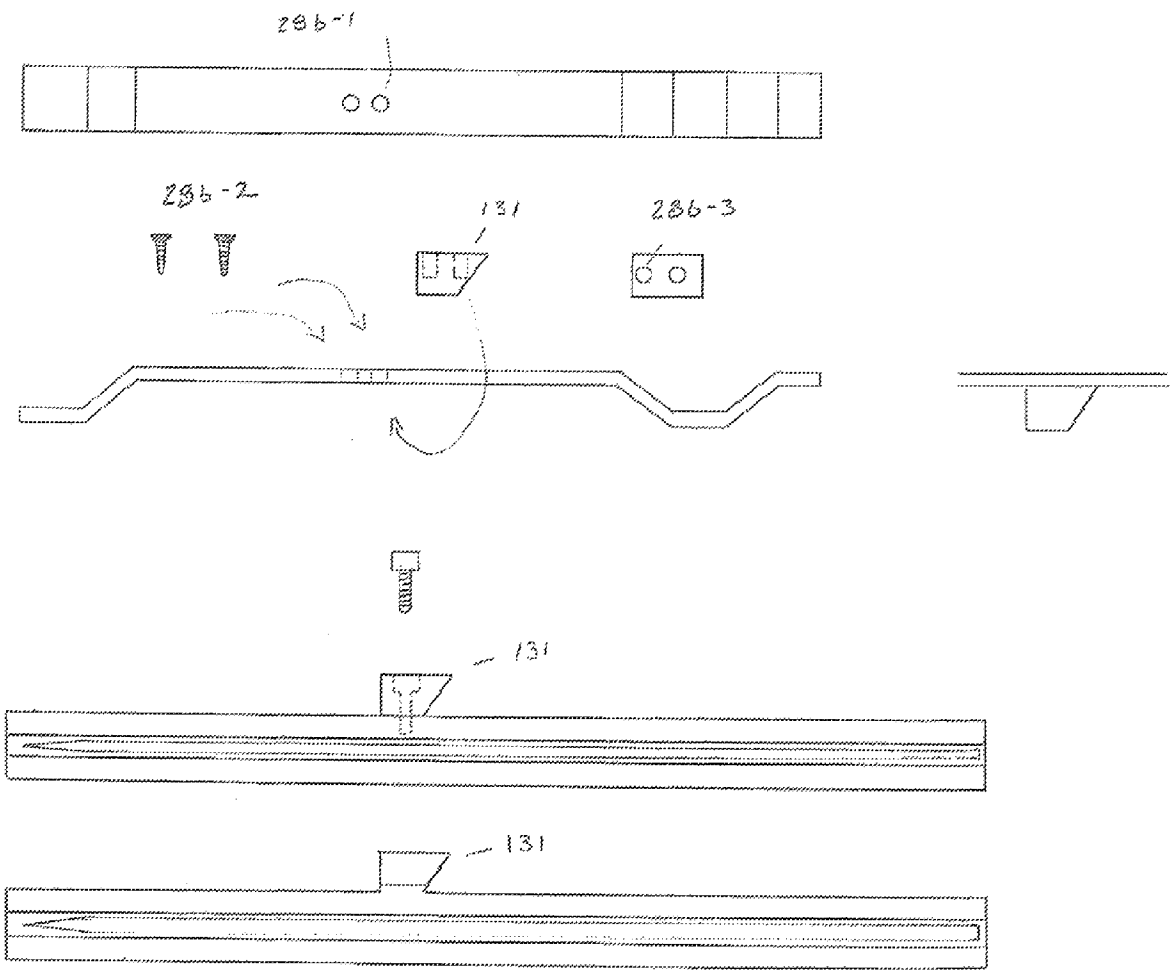
FIG. 28A shows a side view of a modified clip.
FIG. 28B shows an exploded view of a modified clip and height adjuster.
FIG. 28C shows a bottom view of a knife and removable height adjuster.
FIG. 28D shows a bottom view of a knife and inherent height adjuster.

The seventh embodiment of the clip assembly 46 shown in FIGS. 11A, 11B, 12C-12E, 16D-16F, 18A, 18D, 18E and 19A-19E, is comprised of a platform 29*b*-1 shown in FIG. 29B or 29*d*-1 FIG. 29D, a modified clips 20' and 94, a clip draw tab 30, a tensioner pad 45 and a height adjuster 130. The height adjuster 130, clip draw tab 30 and the tensioner pad 45 are all removably attached to the clips. The clip components are adjustably attached to a notched longitudinal channel 129 formed centrally in the clip side and extending through the outer side surface 21 and opening through the inner side surface 22. The notched longitudinal channel 129 extends from the clip connector portion 26 and stops before the clip second end 25. The clip components are attached to this channel by connector means 37. A bottom view of one example of connector means 37 is displayed in FIG. 19E. The machine screw 131 has a tapered head and is inserted into a mounting block 132 with a tapered aperture. The clip draw tab 30, height adjuster 130 and tensioner pad 45 have component mounting blocks 133 formed at their mounting end with threaded apertures 134. The two mounting blocks 132 and 133 bind against the notched channel 129 when the tapered screw 131 is tightened in aperture 134, thus holding the component securely in place. The clip draw tab 30 may also have a second tapered aperture 135 in the second end 35 of its mounting block 133. This feature allows the clip draw tab 30 to be mounted directly opposite a height adjuster 130 by positioning aperture 135 in line with aperture 134 of the height adjuster 130 and inserting and securing tapered machine screw 131 as shown in FIG. 19E. In addition to the channel design, the clip components may also be attached in a discrete user-selected location along the longitudinal axis centrally positioned between the top edge 33' and bottom edge 33 running from clip second end FIG. 16D.—99 (FIG. 1—25) to clip first end FIG. 16D.—98 (FIG. 1—24). A method for the achieving this is to drill apertures FIG. 16D.—95 (FIG. 14E—56 for tensioner pad FIG. 13A—45), FIG. 16D.—96 (FIG. 12D—40 for clip draw tab FIG. 12D—30) and FIG. 16D.—97 (for height adjuster FIG. 19D—130) through the clip as shown in clip segment FIG. 12D—43, FIGS. 14C, 16D and 16E and then fasten the clip components fixedly in place with machined screws 41 or 131 or other connector means 37. FIGS. 12D, 28A and 28B also show this attachment method. FIG. 19D displays a configured modified clip 20'. A similar representation can be obtained with a modified clip 20' by not utilizing the tensioner pad 45. Modified clip 94 can be surface mounted or recess mounted as shown in FIGS. 16C and 16F. Modified clip 20' can be mounted on a platform 29*b*-1 shown in FIG. 29B or 29*d*-1 FIG. 29D. Any or all of the clip components can be positioned on the clip at any given time. An assortment of clip draw tabs, height adjusters, and tensioner pads are available for optimal performance, some are shown in FIGS. 18A, 18D and 18E. FIGS. 20A-20D show a height adjuster comparison to a standard clip placement. FIGS. 20E-20H show a comparison of different settings for the height adjuster. The folding knife container FIG. 20A—136 has an upper seam FIG. 20A—137 which prevents the folding knife from entering deeper into the pocket than the height adjuster. The clip tensioner 49 compresses the material FIG. 20C—138.

Figures 21A, 21B, 21C, 21D:
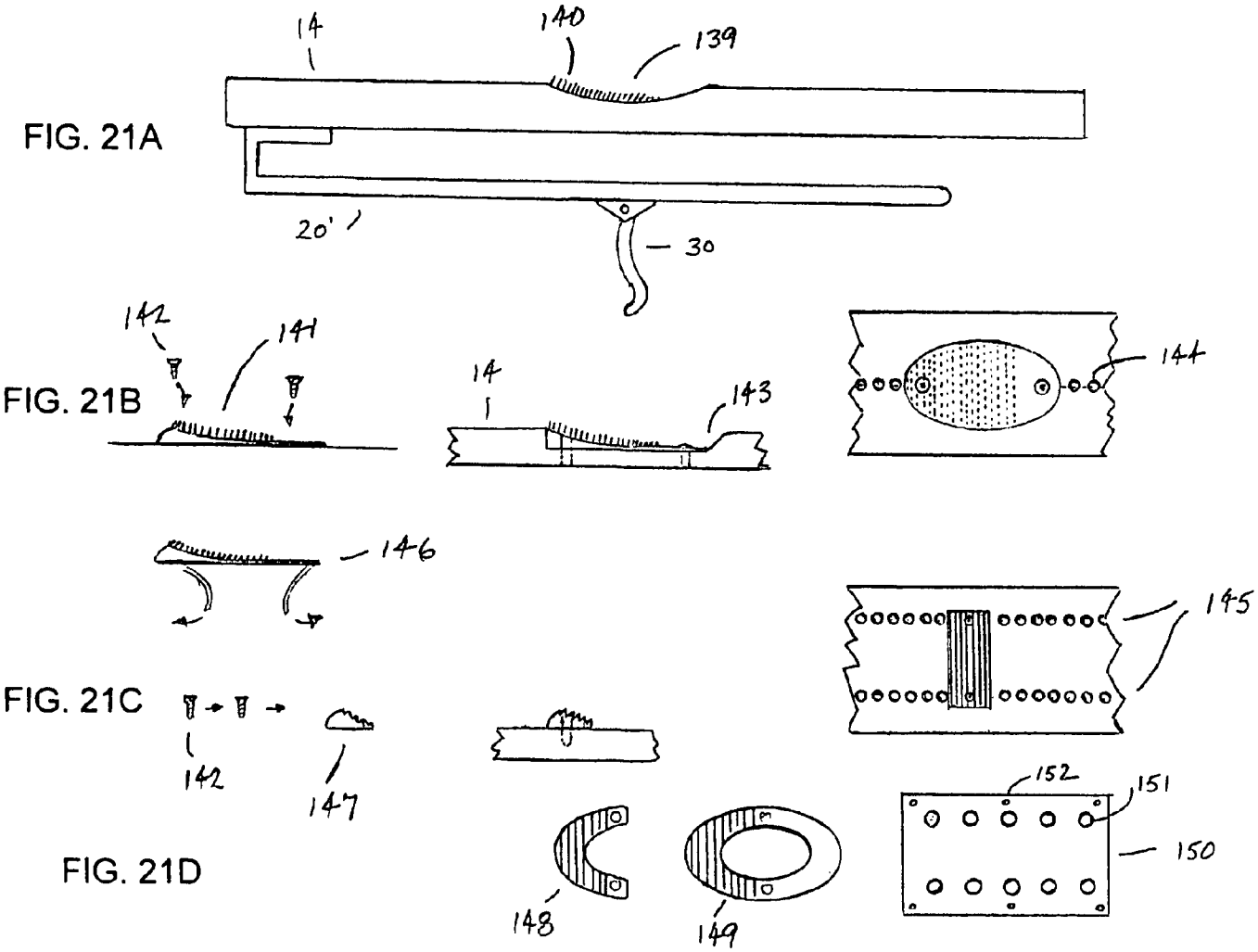
FIG. 21A is a top view of a knife with body draw tab.
FIG. 21B is a bottom and side view of body draw tab features.
FIG. 21C is a bottom and side view of body draw tab features.
FIG. 21D is a bottom and side view of body draw tab features.
Figure 26A:
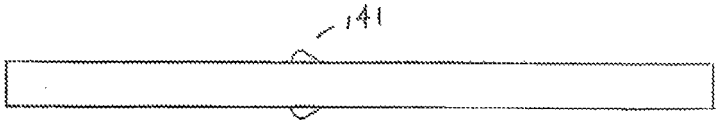
FIG. 26A shows a bottom view of body draw tabs attached to both sides of the knife.
Figure 26B:
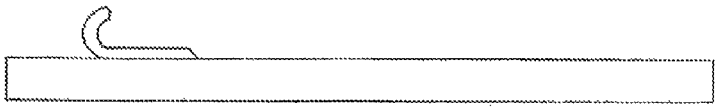
FIG. 26B shows a bottom view of a body draw tab acting as a height adjuster attached the knife.
Figure 26C:
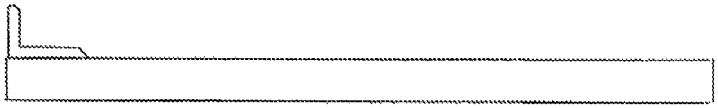
FIG. 26C shows a bottom view of a body draw tab surface mounted to the knife.
Figure 26D:
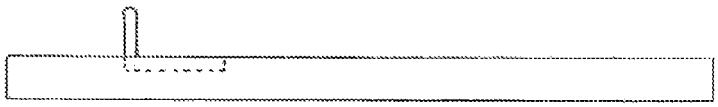
FIG. 26D shows a bottom view of a body draw tab recess mounted to the knife.
Figure 26E:
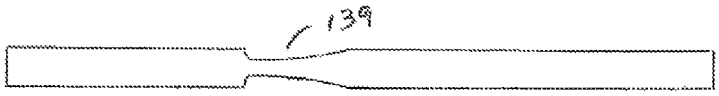
FIG. 26E shows a bottom view of body draw tabs recessed, formed in both sides of the knife.
Figure 26F:
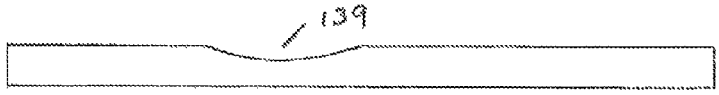
FIG. 26F shows a bottom view of a body draw tab recessed, formed in one side of the knife.
Figure 26G:
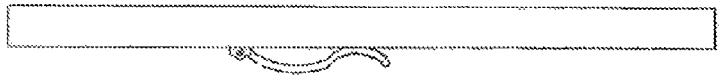
FIG. 26G shows a bottom view of a body draw tab surface mounted to the knife.
Figure 26H:
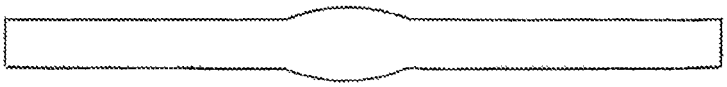
FIG. 26H shows a bottom view of body draw tabs formed in the body of the knife.
Figure 26I:
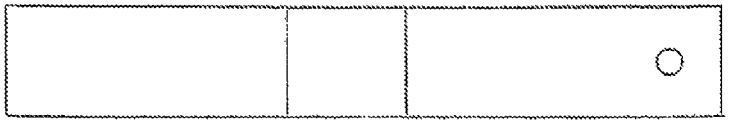
FIG. 26I shows a side view of body draw tabs formed in the body of the knife.
Figure 26J:
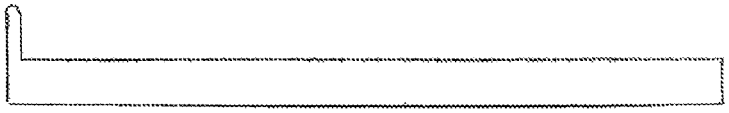
FIG. 26J shows a bottom view of a body draw tab formed in the body of the knife.
Figure 26K:
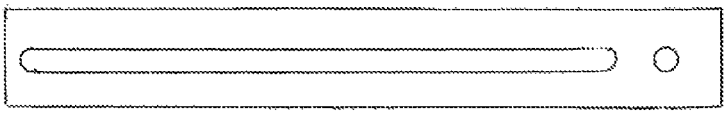
FIG. 26K shows a side view of an attachment channel formed in the body of the knife.
Figure 26L:
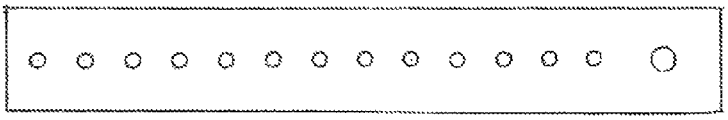
FIG. 26L shows a side view of attachment apertures formed in the body of the knife.
Figure 26M:
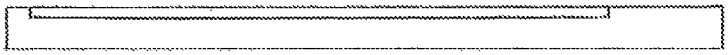
FIG. 26M shows a bottom view of a recessed attachment plate in the body of the knife.
Figure 26N:
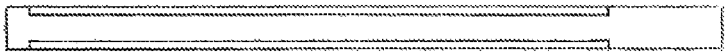
FIG. 26N shows a bottom view of recessed attachment plates in the body of the knife.
Figure 27D:
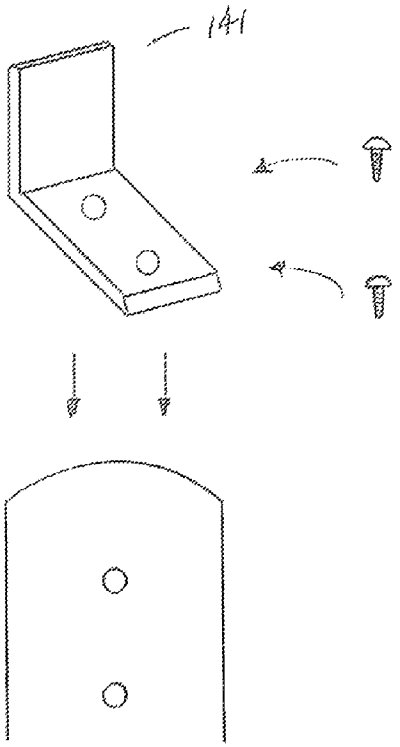
FIG. 27D shows an exploded view of a body draw tab and height adjuster combination and the body of the knife.
Figure 27C:
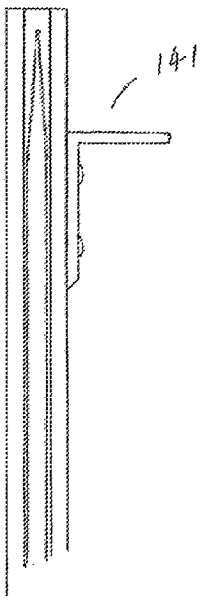
FIG. 27C shows a bottom view of a body draw tab and height adjuster combination mounted to the knife.
Figure 27B:
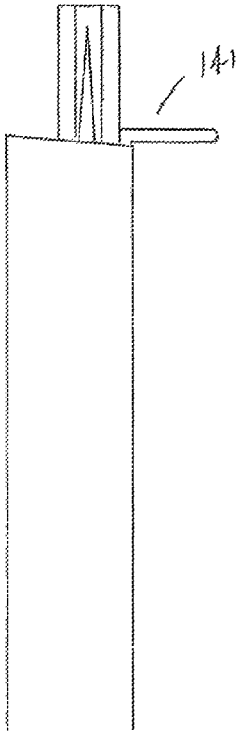
FIG. 27B shows a bottom view of a body draw tab and height adjuster combination mounted to the knife shown inserted in a container.
Figure 27A:
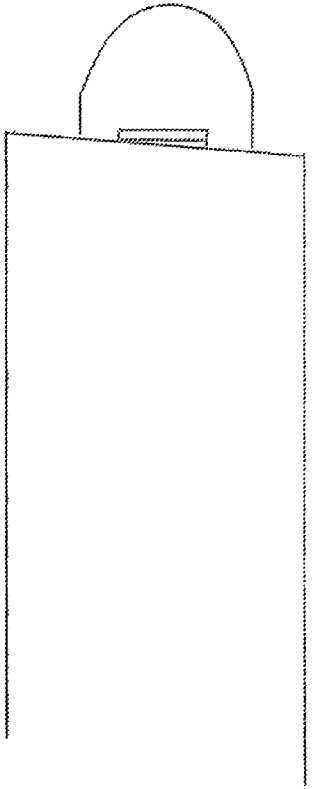
FIG. 27A shows a side view of a body draw tab and height adjuster combination mounted to the knife shown inserted in a container.

The body draw tab 141 shown in FIGS. 21A-21D, 24E, 24G, 24H, 26A-26*n*, 27A-27D is substantially similar in nature to the clip draw tab except for at least four differences. The first is that it is attached to or is inherently formed or shaped from the body 13, side 14 or 14' of the handle 10 of the knife. The second is that the shape of the body draw tab is arranged so that it will not negatively impact the comfort of the user; it will not negatively impact the efficient use of the folding knife; and it will not negatively alter the condition of the container. The third is that it can be attached to either side or both sides of the knife 14 and/or 14'. The fourth is that the body draw tab can act independently as a height adjuster as shown in bottom view FIG. 26B or it may act as a combination height adjuster and body draw tab as shown in a recess mounted bottom view FIG. 26D and surface mounted bottom, side and exploded views FIGS. 27A-d. FIG. 26C shows a bottom view of the body draw tab surface mounted directly to the body of the knife. The body draw tab may utilize any of the shapes shown in FIG. 18A or that shown in FIG. 26G provided they achieve the desired outcome. The shapes shown in FIG. 18A are some of many possible that will achieve the goals of the user. The body draw tab can be formed as part of the body 13, side 14 of the handle 10 as an inherent protruding feature of the handle for a body draw tab 141 shown in FIGS. 26H-26J or as an inherent depression in the handle for a handle body draw tab recessed 139. FIG. 26H shows a top view of inherently formed body draw tabs on each side of the knife handle. FIG. 26I shows a side view of the same. FIG. 26J shows a bottom view of an inherently formed body draw tab. The recess in the body draw tab recessed 139 is shown in FIGS. 21A, 21B and 26F. This recess can also be formed on both sides of the knife as shown in FIG. 26E. It can have tactile-adhesive features 140 within the depression to facilitate grip shown in FIG. 21B. A material formed or shaped into a body draw tab 141 can have many geometrical shapes, such as those shown as 147, 148 or 149 of FIG. 21C or others shown in FIGS. 26A, 26B, 26C, 26D, 26G, 27A-27D. There are many ways to achieve this; one surface of the body draw tab may be comprised of many pointed tiny cylinders standing up and outward against the body 13 of the knife. These pointed cylinders may have an angled nature which points outward and downward in contrast to the thumb's action in a knife draw which is directed upward and inward. The cylinders can be cast of metal or plastics or other tactile-adhesive materials. They may be cast in a shape to be attached to the body of the knife or they may be an inherent aspect of the knife handle 10, body 13, side 14. In addition to different tactile-adhesive material and shapes, a material may formed to be a rigid body draw tab 141 or any practical shape thereof and mounted in a mode shown in the figures. These are mountably-rigid and will allow the body draw tab's textured feature to be mounted to the knife handle 10, body 13, side 14 in various ways. It may be surface mounted FIGS. 21B and 21C with screws 142, adhesive 146 or other practical means; it may be recess mounted 143 with screws 142, adhesive 146 or other practical means. One way the structural body draw tab 141 may be mounted on a handle 10 with apertures 144 or 145 for adjustability or it may be attached to a plate that is mounted to the body 13 of the knife with apertures 152 through plate 150 and adjusted for ease of use with apertures 151. Additional plate and channel options which can be utilized to mount the body draw tab to the body 10 of the knife are shown in FIGS. 26K-26N. The body draw tab may be used in conjunction with the clip and clip draw tab as shown in FIGS. 21A, 24E, 24G and 24H.

A clip draw tab coupler assembly, shown in FIGS. 22A-22D, is a clip draw tab added to an assembly which allows the clip draw tab to be removably attached to a knife clip without any modification of the clip. For use with an existing clip, a clip draw tab coupler 153 may be removably attached by a connector means 37, see FIGS. 22A-22D. The coupler's clip draw tab is shown in top view FIG. 22B—159, in front view FIG. 22B—160, in side view FIG. 22B—161 and in cut-out view FIG. 22B—159'. This coupler method does not require any drilling or other irreversible modification to an existing knife clip. The attachment bracket 157 may be punch-formed out of a piece of high tensile strength sheet metal. Apertures 158 and 159 can be punched into the ends and the structure can be bent into a shape to receive a clip draw tab with inherent threaded base 159'. One method shown utilizes two attachment bolts 154 and two attachment nuts 155. The head of the bolts are beveled so as to fix the head in place while tightening the nut as shown in FIG. 22D. A lock washer 156 or lock-tight adhesive may be used to secure the nuts and prevent them from loosening. The bolts are first placed through one end of the attachment bracket 157 apertures 158 and then the clip draw tab 30 threaded base 159' is threaded onto the attachment bolts 154. As the attachment bolts are exiting from the opposite side of the threaded base 161, the opposite side attachment bracket 157 apertures 158 are engaged. Threading is continued until the clip draw tab is threaded into a position that is centered between the clip 20 bottom edge 23 and top edge 23'. The attachment bolts 154 are fixed perpendicular to the longitudinal axis of the clip 20. The nuts are torqued to hold the clip draw tab coupler 153 securely in place. Various clip draw tabs as shown in FIG. 18A may be formed onto a threaded base that is compatible with the coupler.

Figure 23A:
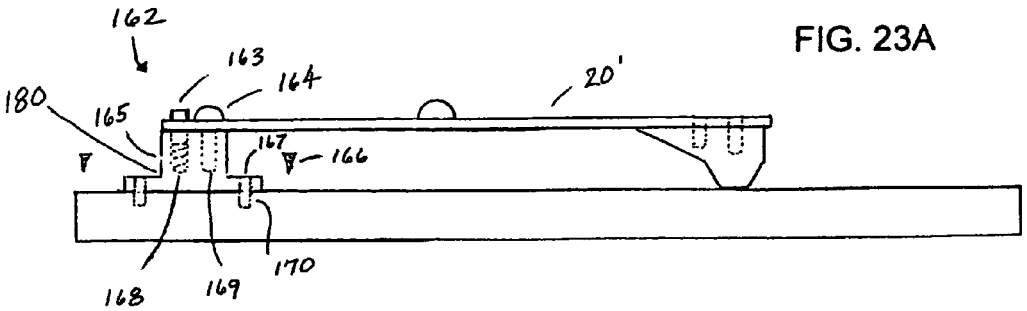
FIG. 23A is a bottom view of rotatable clip assembly on the knife.
Figure 23B:
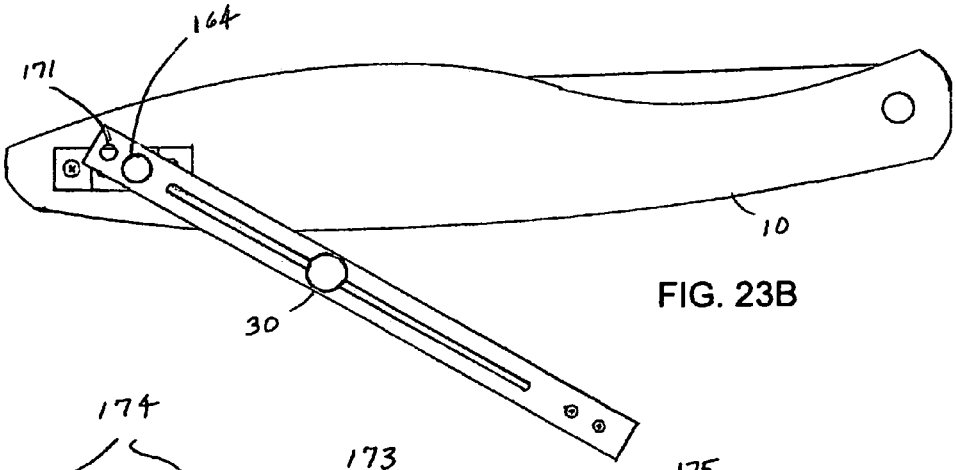
FIG. 23B is a side view of rotatable clip assembly on the knife.

The rotatable clip assembly is shown in FIGS. 23A-23F. Rotatable clip assembly 162 and 176 are attachment methods which utilize platforms 165 and 179 a pin 163 and a pivot bolt 164 which attaches a modified clip 20' to the platform in a way that allows the clip to be positioned on and off axis with the knife handle 10 as shown in FIG. 23B. Platform 165 has several apertures: apertures 167 are for mounting the platform 165 to the handle 10; aperture 168 is for installing the spring 180, the pin 163 and the threaded bushing 181, and aperture 169 is for installing the pivot bolt 164. The machine screws 166 secure platform 165 to body 13, side 14' of handle 10 as they pass through the outer side surface of the platform apertures 167 and are threaded into threaded apertures 170. The spring 180 is inserted into aperture 168. The pin 163 is slid into the threaded bushing 181 as shown in sub-assembly 183 and then the pin and bushing are positioned over aperture 168. In this position the three components are oriented as shown in sub-assembly 183. Threaded bushing 181 is then threaded into aperture 168 until pin 163 is properly spring-loaded. The aperture 171 located closest to the first end 24 of a modified clip 20' is then placed over pin 163. The clip is then aligned parallel to the body 10 so that the modified clip 20' aperture 172 which is located second from the first end 24 of a modified clip 20' is concentrically aligned with aperture 169. Pivot bolt 164 is inserted into aperture 172 of the modified clip 20' and then threaded into aperture 169 of the platform 165. The aperture 171 allows the pin 163, when not depressed, to hold the clip in a fixed position parallel to the knife handle 10. Rotatable clip assembly 176 with platform 179 performs additional functions detailed later. The platform 179 may be mounted to the body 10 with machine screws 166 via apertures 178. One method for mounting the pivot bolt 175 is to thread it directly into the body 10 of the knife. The sub-assembly 183 and the modified clip 20' are installed as described above.

Figure 23C:
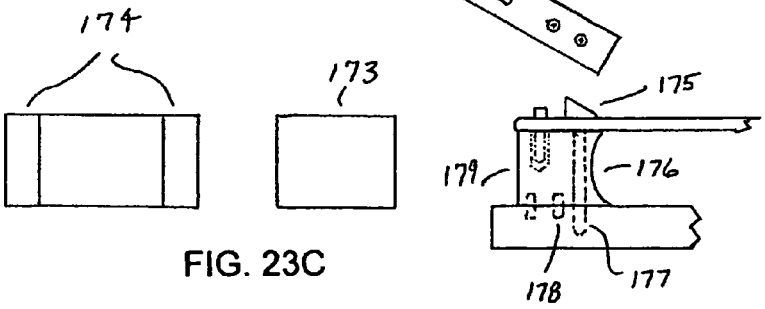
FIG. 23C is a bottom and side view of rotatable clip assembly components and platforms.
Figures 23D, 23E, 23F:
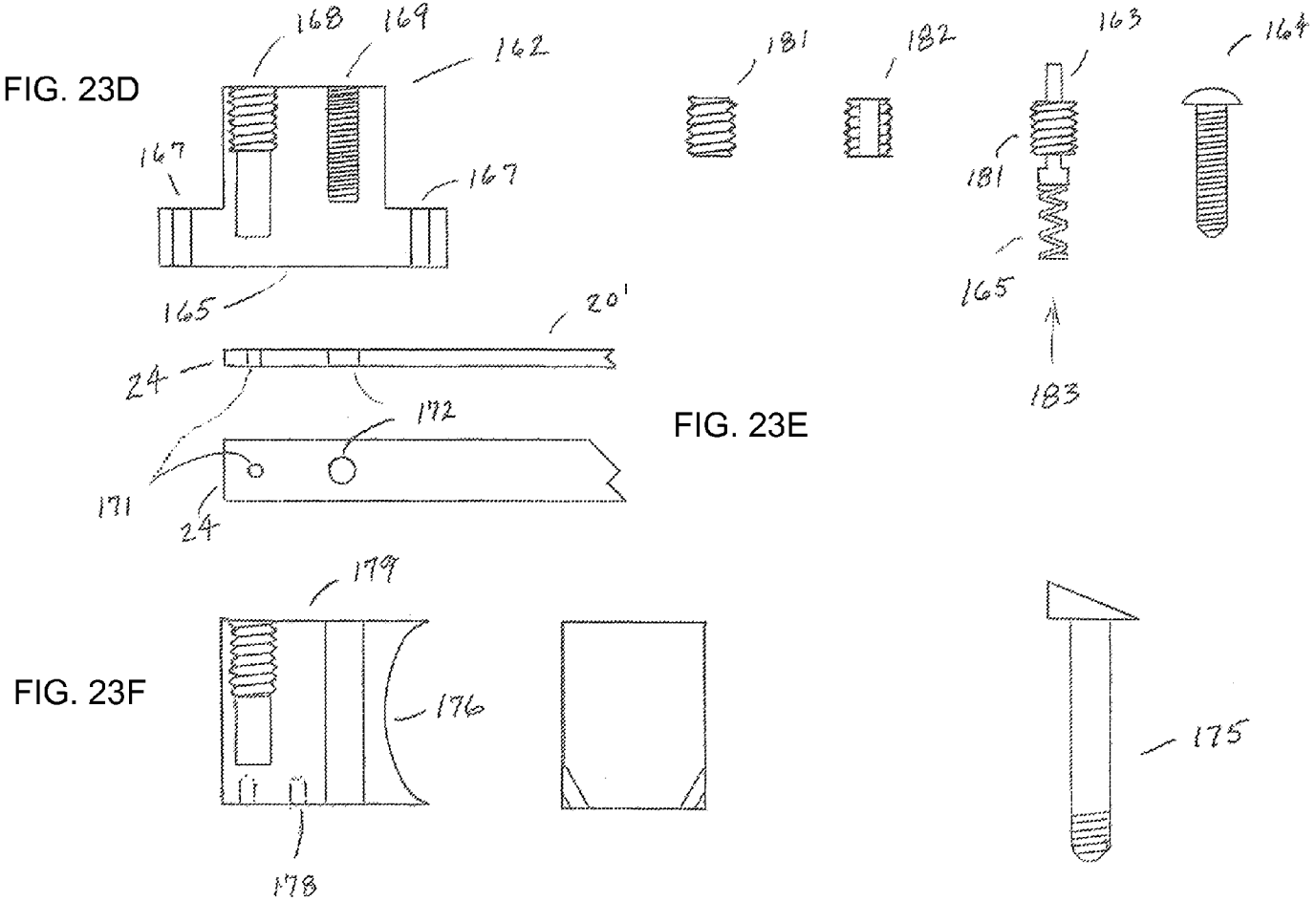
FIG. 23D is a bottom view of rotatable clip assembly and components.
FIG. 23E is a bottom and side view of the rotatable clip.
FIG. 23F is a bottom view of rotatable clip assembly and components.

The platforms shown in FIGS. 29A-29H are either removably attached as shown in FIGS. 29A-B and 29E-f or may be shaped or formed as an inherent feature of the knife body as shown in FIGS. 29C-H and 29G-H. Throughout the document references have been made to the various attachment methods and uses for the platforms. The fundamental purpose of the platform is to provide attachment points and elevation off the body of the knife for the modified clip. The shapes of the platforms can vary. The platform FIG. 23A—165, FIG. 23C—179 as with the prior platforms FIG. 14A—47 and FIG. 14B—48, can be compactly formed so that all mounting hardware is contained within a main block FIG. 23C—173. This removes the need for side mounting fins FIG. 23C—174. The third platform in FIGS. 23C and 23F represent a rotatable clip assembly 176 described above. This platform can be made of a compressible material which allows it to act as a height adjuster, tensioner, rotating clip platform and clip draw tab. A clip draw tab can be formed on top of a pivot bolt to form a pivot bolt 175 which acts as a knife-draw-tab-tensioner-pivot-bolt similar to FIG. 18B threaded pin 105, cone-tipped pin 108 and ball-lock pin 123. The platform is installed as described above. Adjustability of the platform regarding height adjustment can be obtained by utilizing rows of apertures along the body of the knife, by utilizing an attachment plate with apertures or single and multiple channels along its length or by many other means. FIGS. 15C-E, 21B-D, 26K-N show some examples of attachment plates.

The modified clips 20' and 94 shown in FIGS. 3A, 3B, 4A, 4B, 5A, 5B, 6A, 6B, 7A, 7B, 8, 9A, 9B, 10, 11A, 11B, 12A-C, 13A-E, 14C, 15A, 16A-16F, 19A-19E, 20A-H, 21A, 23A-C, 23E, 24A-H, 25A, 25B, 28A, 28B and 29A-D are unique clip designs which can be formed or shaped from various materials. They may be cast from various materials. They are attached to the platforms in a multitude of ways and can be outfitted with many components to realize various outcomes. Throughout the document many shapes have been detailed.

The height adjuster 130 shown in FIGS. 13C-E, 18E, 19C-E, 20C, 20E-H, 23C, 23F, 24B, 24C, 24E, 24G, 25A, 25B, 26B, 27A-D and 28A-28D are either removably attached as shown in FIGS. 28A-C or may be shaped or formed as an inherent feature of the knife body as shown in FIG. 28D. The removably attached height adjuster may be attached to the clip shown in FIG. 28B or may be attached to the body of the knife as shown in FIG. 28C. Throughout the document references have been made to the various attachment methods and shapes for the height adjuster. There has been discussion about body draw tabs acting in a dual purpose role to include height adjustment. Platforms have been demonstrated to act as height adjuster as shown in FIGS. 23C and 23F. The fundamental purpose of the height adjuster is to provide elevation of the knife as it sits in the pocket, holster or other container but they have also served other purposes as shown such as tensioner.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A folding knife, comprising:

a folding knife having a blade rotatably attached to a handle; and at least one structure selected from the group of structures consisting of:

a removable clip configured to adjustably attach said folding knife to a container, said removable clip having a pivot axis aperture and having a second aperture displaced from said pivot axis aperture, said removable clip configured to be held in fixed orientation relative to said folding knife by a pin inserted through said second aperture;

a height adjuster configured to permit adjustment of a position of said folding knife relative to said container;

a clip draw tab configured to be engaged by a hand of a user to assist said user in removing said folding knife from said container;

a tensioner configured to secure said folding knife in said container with sufficient resistance to prevent accidental dislocation of said folding knife from said container; and a body draw tab configured to be engaged by a hand of a user to assist said user in removing said folding knife from said container.

2. The removable knife draw assembly for a folding knife of claim 1, wherein said removable clip is rotatable.

3. The removable knife draw assembly for a folding knife of claim 1, wherein said pin is depressible.

4. A removable knife draw assembly for a folding knife, comprising:

a removable clip configured to adjustably attach a folding knife to a container, said removable clip having a pivot axis aperture and having a second aperture displaced from said pivot axis aperture, said removable clip configured to be held in fixed orientation relative to said folding knife by a pin inserted through said second aperture; and a height adjuster configured to permit adjustment of a position of said folding knife relative to said container.

5. The removable knife draw assembly for a folding knife of claim 4, further comprising a clip draw tab configured to be engaged by a hand of a user to assist said user in removing said knife from said container.

6. The removable knife draw assembly for a folding knife of claim 5, further comprising a tensioner configured to secure said folding knife in said container with sufficient resistance to prevent accidental dislocation of said knife from said container.

7. The removable knife draw assembly for a folding knife of claim 4, wherein said removable clip is rotatable.

8. The removable knife draw assembly for a folding knife of claim 4, further comprising a body draw tab configured to be engaged by a hand of a user to assist said user in removing said knife from said container.

9. The removable knife draw assembly for a folding knife of claim 4, wherein said removable clip comprises a platform and a tensioner pad.

10. A removable knife draw assembly for a folding knife, comprising:

a removable clip configured to adjustably attach a folding knife to a container, said removable clip having a pivot axis aperture and having a second aperture displaced from said pivot axis aperture, said removable clip configured to be held in fixed orientation relative to said folding knife by a pin inserted through said second aperture; and a clip draw tab configured to be engaged by a hand of a user to assist said user in removing said folding knife from said container.

11. The removable knife draw assembly for a folding knife of claim 10, wherein said removable clip is rotatable.

12. The removable knife draw assembly for a folding knife of claim 10, further comprising a tensioner configured to secure said folding knife in said container with sufficient resistance to prevent accidental dislocation of said knife from said container.

13. The removable knife draw assembly for a folding knife of claim 10, further comprising a body draw tab configured to be engaged by a hand of a user to assist said user in removing said knife from said container.

14. The removable knife draw assembly for a folding knife of claim 10, wherein said removable clip comprises a platform and a tensioner pad.

15. A removable knife draw assembly for a folding knife, comprising:

a removable clip configured to adjustably attach a folding knife to a container, said removable clip having a pivot axis aperture and having a second aperture displaced from said pivot axis aperture, said removable clip configured to be held in fixed orientation relative to said folding knife by a pin inserted through said second aperture; and a tensioner configured to secure said folding knife in said container with sufficient resistance to prevent accidental dislocation of said folding knife from said container.

16. The removable knife draw assembly for a folding knife of claim 15, wherein said removable clip is rotatable.

17. The removable knife draw assembly for a folding knife of claim 15, further comprising a body draw tab configured to be engaged by a hand of a user to assist said user in removing said knife from said container.

18. The removable knife draw assembly for a folding knife of claim 15, wherein said removable clip comprises a platform and a tensioner pad.

* * * * *